US005434650A

United States Patent [19]

Nakahara et al.

[11] Patent Number: 5,434,650

[45] Date of Patent: Jul. 18, 1995

[54] SYSTEM FOR TRANSMITTING A MESSAGE INCLUDING USER REQUEST FROM IMAGE FORMING UNIT TO MANAGEMENT UNIT

[75] Inventors: Kazuyuki Nakahara, Toyonaka; Tomofumi Harada, Yokohama; Yasunari Hashimoto, Tokyo; Yasuo Kawada, Kawasaki; Osamu Kizaki, Asaka, all of Japan

[73] Assignee: Ricoh Company, Ltd., Tokyo, Japan

[21] Appl. No.: 163,760

[22] Filed: Dec. 9, 1993

[30] Foreign Application Priority Data

Dec. 11, 1992 [JP] Japan ..... 4-332043

[51] Int. Cl.[6] ..... G03G 15/00

[52] U.S. Cl. ..... 355/202; 355/206

[58] Field of Search ..... 355/200, 202, 204, 206; 371/16.4; 364/138

[56] References Cited

U.S. PATENT DOCUMENTS

| | | | |
|---|---|---|---|
| 4,497,037 | 1/1985 | Kato et al. | 355/202 X |
| 4,583,834 | 4/1986 | Seko et al. | 355/206 |
| 5,138,618 | 8/1992 | Honda et al. | 371/16.4 |
| 5,220,380 | 6/1993 | Hirata et al. | 355/204 |
| 5,325,156 | 6/1994 | Ulinski | 355/204 X |
| 5,335,048 | 8/1994 | Takano et al. | 355/204 |
| 5,347,346 | 9/1994 | Shimizu et al. | 355/202 |

FOREIGN PATENT DOCUMENTS

| | | |
|---|---|---|
| 2-257155 | 10/1990 | Japan . |
| 2-259666 | 10/1990 | Japan . |
| 3-196053 | 8/1991 | Japan . |

*Primary Examiner*—Joan H. Pendegrass

*Attorney, Agent, or Firm*—Oblon, Spivak, McClelland, Maier & Neustadt

[57] ABSTRACT

An image forming unit management system includes: an image forming unit; a communication control unit for connecting the image forming unit to a management unit via a communication line to transmit a message from the image forming unit to the management unit and to transmit a response message from the management unit to the image forming unit; a storage part for storing a plurality of message codes respectively indicating a plurality of message types; an operation part for inputting a message type and a request for transmitting a message of the message type to the management unit; a first control part for setting one of the plurality of message codes that corresponds to the input message type and for transmitting a message including the message code to the communication control unit if the request is inputted from the operation part; and a second control part for transmitting the message, received from the first control part, to the management unit, and for transmitting a response message to the image forming unit if the response message is received from the management unit.

14 Claims, 36 Drawing Sheets

ENTER PASSWORD

SELECT 5

BY REMOTE MESSAGE KEY

BY SELF DIAGNOSTIC

BY PRELIMINARY WARNING

FIG.16

| PARAMETERS | | | DATA LENGTH |
|---|---|---|---|
| COPIER (ADDRESS 1) | MACHINE TYPE | | 6 |
| | SERIAL NO. | | 10 |
| | CHECK SUM | | 4 |
| COPIER (ADDRESS 2) | MACHINE TYPE | | 6 |
| | SERIAL NO. | | 10 |
| | CHECK SUM | | 4 |
| COPIER (ADDRESS 3) | MACHINE TYPE | | 6 |
| | SERIAL NO. | | 10 |
| | CHECK SUM | | 4 |
| COPIER (ADDRESS 4) | MACHINE TYPE | | 6 |
| | SERIAL NO. | | 10 |
| | CHECK SUM | | 4 |
| COPIER (ADDRESS 5) | MACHINE TYPE | | 6 |
| | SERIAL NO. | | 10 |
| | CHECK SUM | | 4 |
| REMOTE MESSAGE KEY | RECIPIENT TEL NO. | | 32 |
| | NO. OF REDIALING | | 2 |
| | REDIAL INTERVALS | | 3 |
| | ADDED TO MESSAGE IF APPLICABLE | NO. OF JAMS | 1 |
| | | NO. OF TROUBLES | 1 |
| | | NO. OF COPIES | 1 |
| | | COPIER CONDITION | 1 |
| | CHECK SUM | | 4 |
| SELF DIAGNOSTIC | RECIPIENT TEL NO. | | 32 |
| | NO. OF REDIALING | | 2 |
| | REDIAL INTERVALS | | 3 |
| | ADDED TO MESSAGE IF APPLICABLE | NO. OF JAMS | 1 |
| | | NO. OF TROUBLES | 1 |
| | | NO. OF COPIES | 1 |
| | | COPIER CONDITION | 1 |
| | CHECK SUM | | 4 |
| PRELIMINARY WARNING | RECIPIENT TEL NO. | | 32 |
| | NO. OF REDIALING | | 2 |
| | REDIAL INTERVALS | | 3 |
| | ADDED TO MESSAGE IF APPLICABLE | NO. OF JAMS | 1 |
| | | NO. OF TROUBLES | 1 |
| | | NO. OF COPIES | 1 |
| | | COPIER CONDITION | 1 |
| | TRANSMISSION TIME | | 4 |
| | CHECK SUM | | 4 |

(a) USER MESSAGE DATA (COPIER→CCU)

(b) USER MESSAGE DATA (CCU→MANAGEMENT UNIT)

(c) RESPONSE MESSAGE DATA (CCU→COPIER)

FIG. 21A (a) READ PROCESS

MANAGEMENT UNIT→CCU

| | | |
|---|---|---|
| CCU CODE | READ REQUEST CODE | ITEM CODE |

CCU→MAMAGEMENT UNIT

| | | | |
|---|---|---|---|
| CCU CODE | READ RESPONSE CODE | ITEM CODE | READ DATA |

FIG. 21B (b) WRITE PROCESS

MANAGEMENT UNIT→CCU

| | | | |
|---|---|---|---|
| CCU CODE | WRITE REQUEST CODE | ITEM CODE | WRITE DATA |

CCU→MAMAGEMENT UNIT

| | | | |
|---|---|---|---|
| CCU CODE | WRITE RESPONSE CODE | ITEM CODE | WRITE DATA |

FIG. 21C (c) EXECUTE PROCESS

MANAGEMENT UNIT→CCU

| | | | |
|---|---|---|---|
| CCU CODE | EXECUTE REQUEST CODE | ITEM CODE | COMMENT |

CCU→MAMAGEMENT UNIT

| | | | |
|---|---|---|---|
| CCU CODE | EXECUTE RESPONSE CODE | ITEM CODE | COMMENT |

CCU→COPIER

| | |
|---|---|
| READ REQUEST CODE | ITEM CODE |

COPIER→CCU

| | | |
|---|---|---|
| READ RESPONSE CODE | ITEM CODE | READ DATA |

(a) USER MESSAGE DATA (COPIER→CCU)

(b) USER MESSAGE DATA (CCU→MANAGEMENT UNIT)

(c) RESPONSE MESSAGE DATA (CCU→COPIER)

SYSTEM FOR TRANSMITTING A MESSAGE INCLUDING USER REQUEST FROM IMAGE FORMING UNIT TO MANAGEMENT UNIT

BACKGROUND OF THE INVENTION

The present invention relates to an image forming unit management system which connects an image forming unit such as a copier to a management unit at a remote side via a communication line to transmit a user message from the image forming unit to the management unit via the communication line and to transmit a response message from the management unit to the image forming unit via the communication line.

Some image forming unit management systems have been proposed in the prior art. For example, Japanese Laid-Open Patent Publication Nos. 2-257155, 2-259666 and 3-196053 disclose proposed image forming unit management systems. Each of these systems connects a plurality of image forming units (such as copiers) at user facilities to a management unit (such as a host computer) at a remote site via a public communication line.

With the proposed management systems disclosed in the above publications, the maintenance of the plurality of image forming units can be carried out by the management unit in a centralized manner. The use conditions (e.g. the number of copies) of the image forming units can be easily collected by the management unit, and the management data is utilized for the maintenance of the respective image forming units.

In the proposed management systems, some maintenance functions of the management unit are available. As one of the maintenance functions, the result of the self-diagnostic function of the image forming unit can be transmitted to the management unit after it is automatically called from the user facility via a public communication line. As another maintenance function, the management unit gains access to the image forming unit through a public communication line so that the operating condition or setting of the image forming unit can be adjusted by the management unit at the remote site.

By using the proposed management system, a message with the number of copies is transmitted from the image forming unit to the management unit via the public communication line. As the number of copies is available at the management unit with the message received from the image forming unit, a monthly charge for the maintenance of the image forming unit can be calculated based on the number of copies. Conventionally, in order to calculate the monthly charge, it was necessary to collect the maintenance data such as the number of copies by making a telephone call to the user or a maintenance person's visit to the user facility.

In some cases, the user of the image forming unit has to call a service center in order to request the repair of the image forming unit with the irregular noise or the poor copy image, to request the supply of service parts such as copy sheets or toner cartridges, or to ask how to operate the image forming unit. However, in the case of the proposed management system, it is difficult to simply and efficiently transmit a message including the request or the inquiry from the image forming unit to the management unit via the communication line. It is difficult to simply and efficiently transmit a response message from the management unit to the image forming unit via the communication line.

SUMMARY OF THE INVENTION

Accordingly, it is a general object of the present invention to provide a novel and useful image forming unit management system in which the above mentioned problems are eliminated.

Another, more specific object of the present invention is to provide an image forming unit management system which can simply and efficiently transmit a user message including the user request or inquiry from an image forming unit to a management unit via a communication line and can simply and efficiently transmit a response message from the management unit back to the image forming unit.

The above mentioned objects of the present invention are achieved by an image forming unit management system which includes: an image forming unit; a communication control unit for connecting the image forming unit to a management unit via a communication line to transmit a user message from the image forming unit to the management unit and to transmit a response message from the management unit to the image forming unit; a storage part for storing a plurality of message codes respectively indicating a plurality of message types; an operation part provided in the image forming unit for inputting a message type and a request that a user message of the message type is transmitted from the image forming unit to the management unit through the communication control unit; a first control part coupled to the operation part for setting one of the plurality of message codes stored in the storage part, that corresponds to the message type inputted from the operation part, and for transmitting a user message including the message code to the communication control unit if the request is inputted from the operation part; and a second control part provided in the communication control unit for transmitting the user message, received from the first control part, to the management unit, and for transmitting a response message to the image forming unit when the response message is received from the management unit.

The above mentioned objects of the present invention are achieved by an image forming unit management system which includes: an image forming unit; a plurality of management units located at remote sites; a communication control unit for connecting the image forming unit to each of the plurality of management units via a communication line to transmit a user message from the image forming unit to the management unit of interest; a storage part provided in the image forming unit for storing a plurality of message codes respectively indicating a plurality of message types; an operation part provided in the image forming unit for inputting a message type and a request that a user message of the message type is transmitted from the image forming unit to the management unit through the communication control unit; a first control part coupled to the operation part for setting one of the plurality of message codes stored in the storage part, that corresponds to the message type inputted from the operation part, and for transmitting a user message including the message code to the communication control unit if the request is inputted from the operation part; a second control part provided in the communication control unit for detecting the message code of the user message received from the first control part to determine a destination management unit among the plurality of management units; and a third control part coupled to the second control part for transmitting the user message, received from the first control part, to the destination management unit via the communication line.

With the image forming unit management system according to the present invention, it is possible to simply and efficiently transmit a user message from one of the image forming units to the management unit at a remote site via the communication line. It is possible to simply and efficiently transmit a response message from the management unit to the image forming unit of interest via the communication line. In addition, it is possible to facilitate the maintenance of a plurality of image forming units at user facilities by making use of the management unit through the communication control unit, so that the maintenance load of the user is reduced.

BRIEF DESCRIPTION OF THE DRAWINGS

The above and other objects, features and advantages of the present invention will be more apparent from the following detailed description when read in conjunction with the accompanying drawings in which:

FIG. 16 is a diagram showing the parameters used by the communication control unit in FIG. 8;

FIG. 21 is a diagram showing the data format of messages when the read, write and execute processes between the communication control unit and the management unit are performed;

DESCRIPTION OF THE PREFERRED EMBODIMENTS

A description will now be given, with reference to FIGS. 1 through 6C, of an image forming unit which is placed under the management control by the image forming unit management system according to the present invention.

Figure 1:
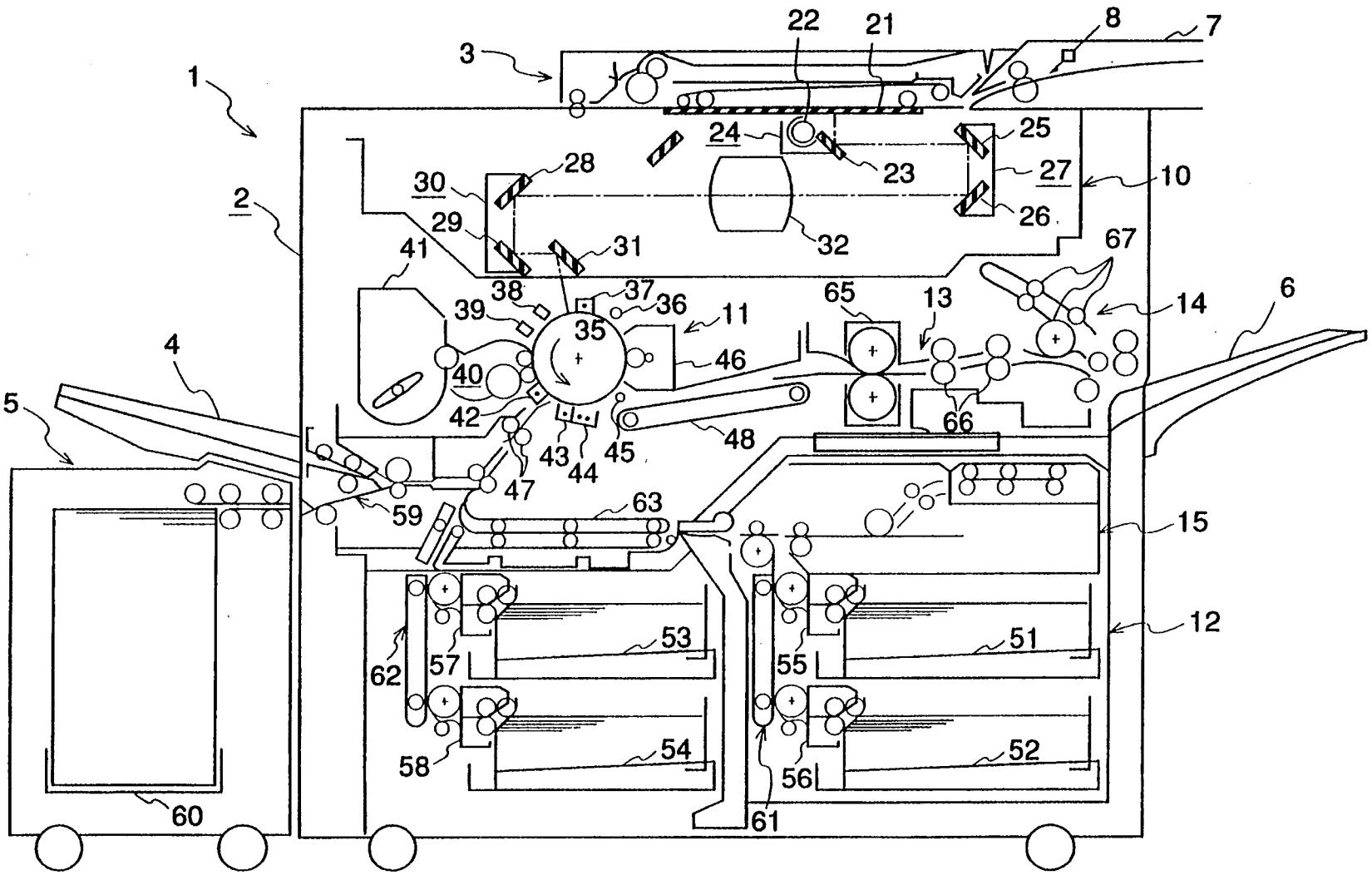
FIG. 1 is a sectional view showing a copier which is an image forming unit provided in an image forming unit management system.

FIG. 1 shows a copier which is used as an example of the image forming unit. This copier is an electrophotographic type, plain paper copier (PPC). In FIG. 1, the PPC copier 1 has a main part 2 and an automatic document feeding (ADF) unit 3 mounted on the main part 2. The ADF unit 3 is used to automatically supply a plurality of document sheets to the main part 2 one by one. The ADF unit 3 is provided with a document tray 7 and a document set sensor 8. The document set sensor 8 detects the presence of a document on the document tray 7 and supplies a detection signal to the main part 2.

A manual sheet tray 4 and a sheet storage 5 are provided at one side of the main part 2 of the copier 1 in FIG. 1. The manual paper tray 4 is used to manually supply a copy sheet to the main part 2. The sheet storage 5 has a sheet tray 60 for storing a large number of copy sheets thereon. The copy sheets in the sheet storage 5 are continuously supplied to the main part 2 one by one. On the other side of the main part 2, a paper ejection tray 6 is provided. The copy sheets after the image forming is completed are ejected to the paper ejection tray 6.

The main part 2 of the PPC copier 1 in FIG. 1 comprises a scanner unit 10, an image forming unit 11, a sheet supplying unit 12, a fixing and ejecting unit 13, a reversing unit 14, and a dual copy unit 15.

The scanner unit 10 includes a contact glass 21, a first scanner 24, a second scanner 27, and a third scanner 30. The first scanner 24 has an exposure lamp 22 and a first mirror 23. The second scanner 27 has second and third mirrors 25 and 26. The third scanner 30 has fourth and fifth mirrors 29 and 29. The scanner unit 10 includes a sixth mirror 31 and a lens 32.

The image forming unit 11 has a photosensitive drum 35. Around the photosensitive drum 35, a quenching lamp 36, a first charger 37, an eraser 38, an electric potential sensor 39, a developing unit 40 with a toner cartridge 41, a pre-transfer charger 42, a transfer charger 43, a separation charger 44, a position sensor 45, and a cleaning unit 46 are arranged in this order.

The fixing and ejecting unit 13 has a fixing unit 65 for subjecting a copy sheet to the image fixing, and it has a plurality of ejecting rollers 66 for ejecting a copy sheet out of the main part 2. The reversing unit 14 has a plurality of reversing rollers 67 for reversing a copy sheet upside down. The dual copy unit 15 is used to produce a two-sided copy through the image forming.

A copy sheet from the manual paper tray 4 or the sheet storage 5 is supplied to the photosensitive drum 35 through a sheet transport path. A pair of registration rollers 47 are provided at an intermediate position of the sheet transport path so that a copy sheet is supplied by the registration rollers 47 to the photosensitive drum 35 at a rate synchronous with the rotation of the photosensitive drum 35. A sheet transporting belt 48 is provided between the image forming unit 11 and the fixing and ejecting unit 13. In the image forming unit 11, a latent image on the photosensitive drum 35 is transferred to the copy sheet, and the copy sheet is supplied to the fixing unit 65 by means of the sheet transport belt 48.

The sheet supplying unit 12 is provided with first through fourth sheet trays 51–54. These sheet trays 51–54 are used to store a plurality of copy sheets and supply them to the image forming unit 11. The sheet trays 51–54 respectively include first through fourth sheet supplying parts 55–58. The sheet supplying parts 55–58 includes rollers for supplying the copy sheets, stored in the sheet supplying unit 12, to the registration rollers 47 one by one. The sheet supplying unit 12 further includes a fifth sheet supplying part 59, and this fifth sheet supplying part 59 supplies a copy sheet from the manual sheet tray 4 or the sheet storage 5 to the registration rollers 47.

In order to transport the copy sheet from one of the sheet supplying parts 55–59 or the dual copy unit 15 to the registration rollers 47, a right-hand transporting part 61, a left-hand transporting part 62 and a horizontal transporting part 63 are provided.

The photosensitive drum 35 is rotatably supported within the main part 2, and it is rotated in a direction indicated by the arrow A in FIG. 1 in accordance with a copy command. A document supplied by the ADF unit 3 onto the contact glass 21 is exposed to light emitted from the exposure lamp 22. This document is optically scanned by the first scanner 24. The light reflected from the document is converted by the first, second and third mirrors 23–25, the lens 32, the fourth, fifth and sixth mirrors 28, 29 and 31 into a converging light. The converging light from the scanner unit 10 is focused on the photosensitive drum 35.

The surface of the photosensitive drum 35 is electrostatically charged by the first charger 37, and it is exposed to the converging light of the scanner unit 10 so that a latent image is formed on the photosensitive drum 35 in accordance with the image of the document. The eraser 38 is used to eliminate an undesired image of the surface of the photosensitive drum 35 so that the latent image is corrected so as to become suitable for transferring it to a copy sheet. When an image is formed on a copy sheet with no enlargement nor reduction, the photosensitive drum 35 is rotated in the direction "A" at a rate pursuant to the speed of the movement of the first scanner 24.

The latent image on the photosensitive drum 35 is converted into a toner image by the developing unit 40. By applying a suitable bias voltage to the developing unit 40, it is possible to produce a toner image with a desired optical density.

A copy sheet from one of the first through fourth trays 51–54, the manual sheet tray 4, the sheet storage 60, and the dual copy unit 15, is supplied to the registration rollers 47 at a given rate by corresponding one of the sheet supplying parts 55–59. The copy sheet is transported to the registration rollers 47 through any of the right-hand transporting part 61, the left-hand transporting part 62 and the horizontal transporting part 63. The copy sheet at this position is sent to the photosensitive drum 35 by the registration rollers 47 at a rate synchronous with the rotation of the photosensitive drum 35 in a manner such that the copy sheet edge and the toner image edge accord with each other.

The toner image on the photosensitive drum 35 is transferred to the copy sheet by means of the pre-transfer charger 42 and the transfer charger 43. The surface of the photosensitive drum 35 at this time is very smooth, and the copy sheet adheres to the photosensitive drum surface by electrostatic force. The separation charger 44 serves to reduce the potential of the copy sheet so that the adhering force of the copy sheet is lowered.

The copy sheet with the toner image transferred thereto is separated from the photosensitive drum 35 by a separating part (not shown), and the copy sheet is transported to the fixing unit 65 by the transporting belt 48. The copy sheet at this position is subjected to the heat and pressure by the fixing unit 65 so that the toner image is fixed to the copy sheet. After the fixing is completed, the copy sheet is transported by the ejecting rollers 66 to the paper ejection tray 6, located outside the copier.

In the event that a two-sided copy is produced, the reversing unit 14 and the dual copy unit 15 are used. The copy sheet from the fixing unit 65 is transported to the reversing unit 14. The copy sheet is then supplied from the reversing unit 14 to the dual copy unit 15. The copy sheet after it is supplied from the dual copy unit 15 is turned upside down, and it is transported to the image forming unit 11 at a given rate, so that a two-sided copy is produced by the image forming unit 11.

As toner remains on the surface of the photosensitive drum 35 after the toner image is transferred to the copy sheet, the remaining toner is removed from the photosensitive drum surface by means of a brush and a cleaning blade of the cleaning unit 46. The quenching lamp 36 serves to maintain the potential of the photosensitive drum surface at a desired level.

The timing of the operations of the component parts described above is controlled in accordance with pulses supplied from a control unit of the copier 1. The control unit generates the pulses synchronously with the rotation of the photosensitive drum 35.

Figure 2:
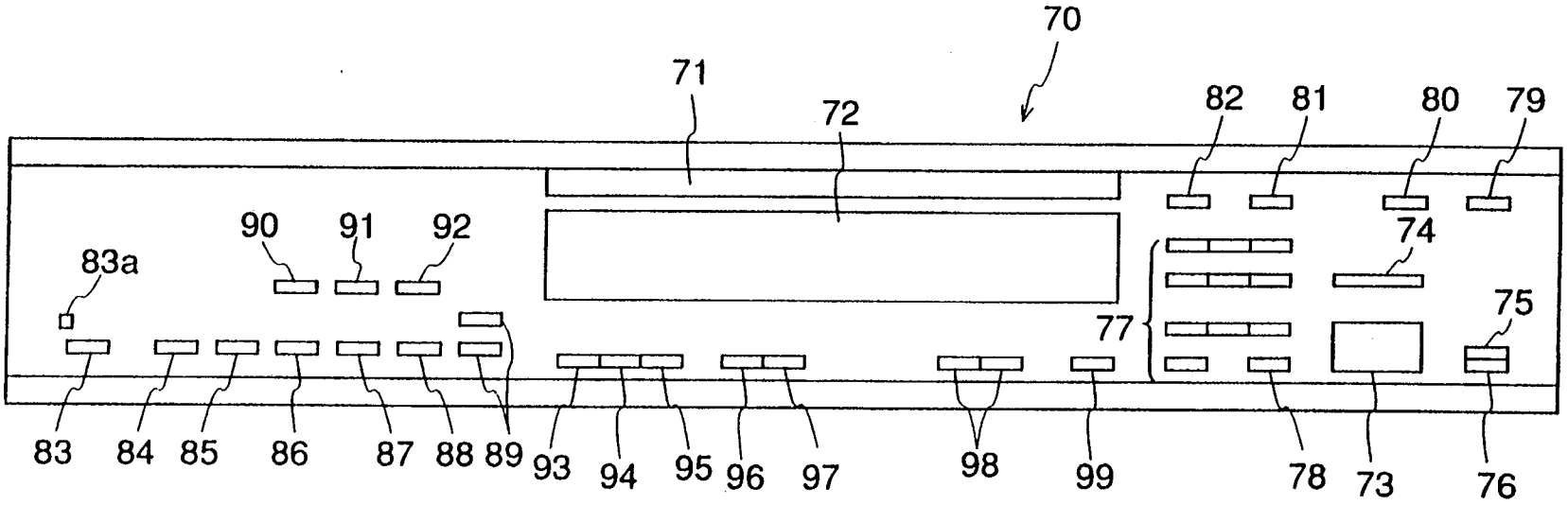
FIG. 2 is a view showing an operation part of the copier in FIG. 1.

FIG. 2 shows an operation part of the copier 1 in FIG. 1. The operation part 70 is provided within the copier 1 to input any operation command set by an operator. In FIG. 2, a guidance display portion 71 and a pattern display portion 72 are provided in the middle of the operation part 70. These display portions employ a liquid crystal display (LCD) device to indicate information relating to the operation of the copier 1.

At the right side of the display portions 71 and 72 of the operation part 70 in FIG. 2, there are provided a start key 73, an interrupt key 74, a preheat key 75, a mode clear and preheat key 76, a set of ten keys 77, a clear and stop key 78, a timer key 79, a program key 80, an enter key 81, and a guidance key 82. At the left side of the display portions 71 and 72, there are provided a remote message key 83, a sorter key 84, a dual copy key 85, a continuous page copy key 86, a delete key 87, a sheet-size-selective magnified copy key 88, a zoom key 89, a page offset key 90, a centering key 91, and a sheet size key 92. Below the display portions 71 and 72, there are provided a reduce key 93, an enlarge key 94, a non-magnified copy key 95, a sheet select key 96, an auto sheet select key 97, a pair of density adjust keys 98, and an auto density set key 99.

If the remote message key 83 is ON, a remote message lamp **83*a* above the remote message key 83 is lit during the transmission of the remote message. The remote message lamp 83*a*** uses a light emitting diode (LED).

Figure 3:
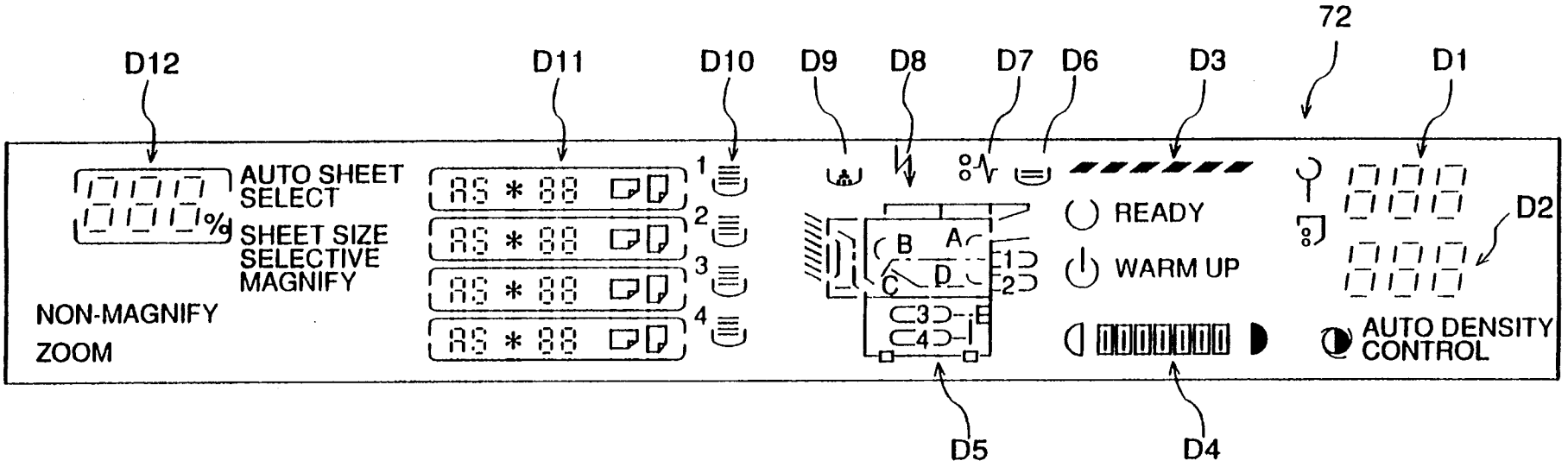
FIG. 3 is an enlarged view showing a display portion of the operation part in FIG. 2.

FIG. 3 shows the pattern display portion of the operation part in FIG. 2. In the pattern display portion 72 in FIG. 3, there are provided a copy number setting indicator D1, a copy number indicator D2, a running indicator D3, a density setting indicator D4, a mis-feed position indicator D5, a paper supply indicator D6, a mis-feed indicator D7, a remote message alarm indicator D8, a toner supply indicator D9, a set of sheet remainder indicators D10, a set of sheet size and direction indicators D11, and a magnification rate indicator D12.

In the guidance display portion 71 in FIG. 2, messages relating to operational guidance and warning of the operation of the copier 1 are indicated to notify them to the user. It should be noted that the operation part 70 is provided with the remote message key 83 to allow the user at the image forming unit to request the management unit at a remote side through a public network of any service from the management unit, and that the pattern display portion 72 is provided with the remote message alarm indicator D8 to allow the user to notice the occurrence of any trouble relating to the remote message transmitted to the remote site.

Instead of the remote message key 83 and the remote message alarm indicator D8, the function equivalent to the above described function can be attained by using a combination of the other existing keys and indicators of the operation part.

Figure 4:
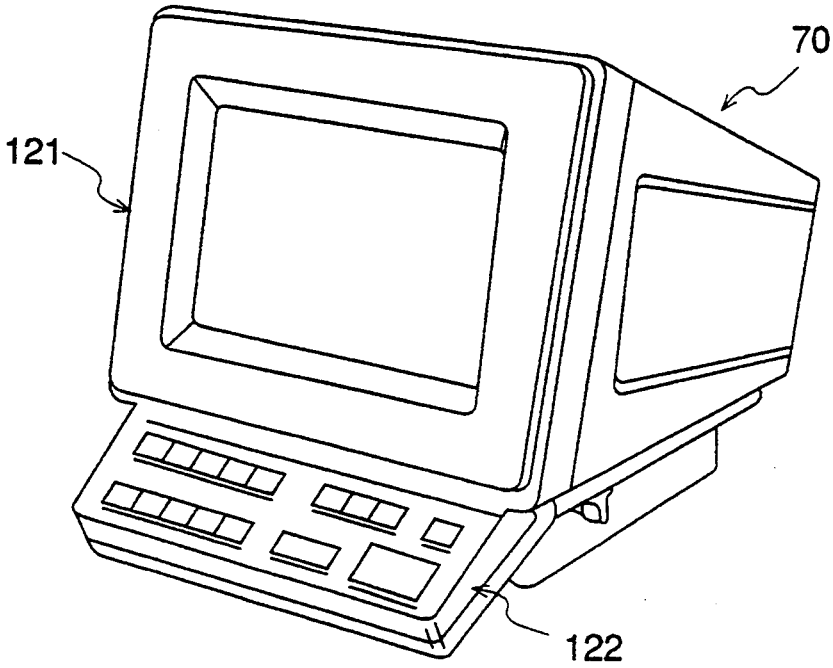
FIG. 4 is a perspective view showing another example of the operation part of the image forming unit.
Figure 5:
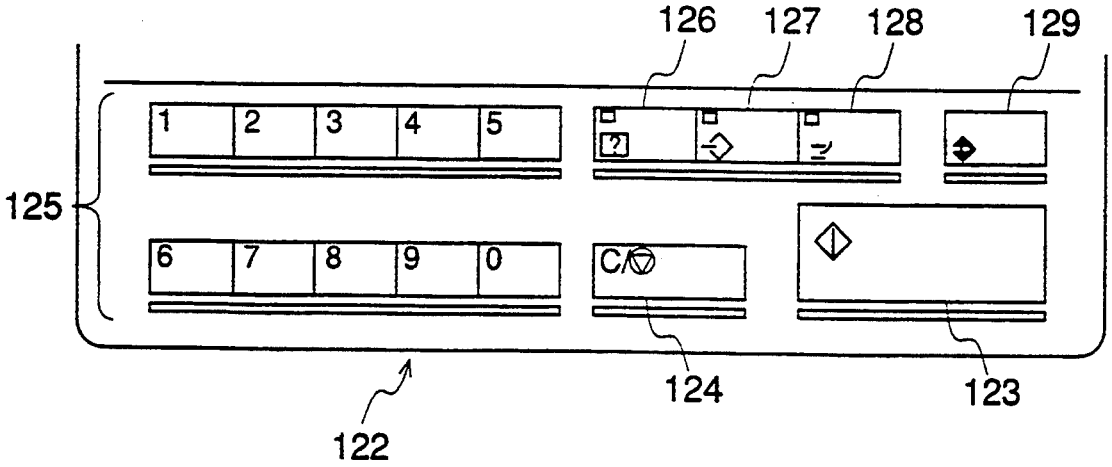
FIG. 5 is an enlarged view showing an operation panel of the operation part in FIG. 4.

FIG. 4 shows another example of the operation part of the copier in FIG. 1. As shown in FIG. 4, the operation part 70 of this example comprises a touch-panel display unit 121 and an operation panel 122. FIG. 5 shows the operation panel 122 of the operation part in FIG. 4. In FIG. 5, the operation panel 122 includes a start key 123, a clear and stop key 124, a set of ten keys 125, a guidance key 126, a program key 127, an interrupt key 128, and a mode clear key 129.

The touch-panel display unit 121 is a cathode ray tube (CRT) display unit which has a CRT display screen incorporating the touch panel. The user can input a desired instruction to the copier by touching any key of the touch panel of the display unit 121, and can view on the CRT display screen any message relating to the operation of the copier.

Figure 6A:
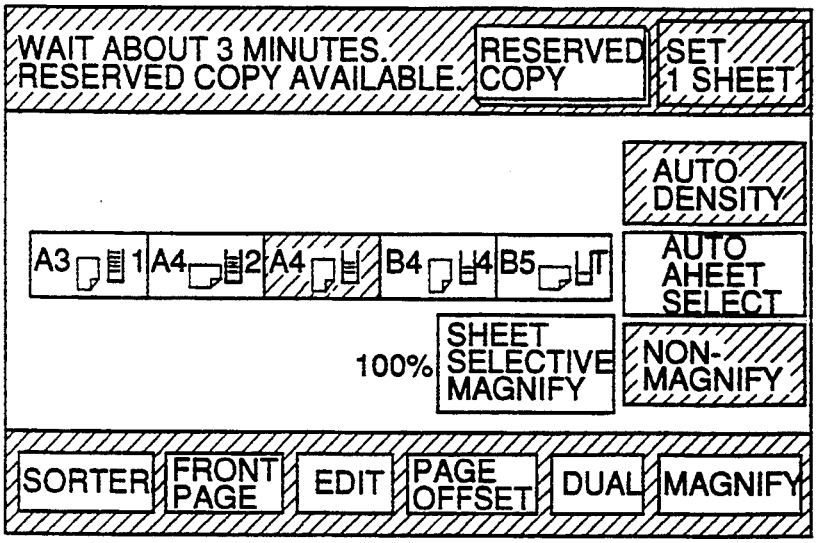
FIGS. 6A through 6C are diagrams showing display screens indicated by the operation part of the image forming unit in FIG. 4.

The touch-panel display unit 121 can be operated in a user programming mode. When it is operated in the user programming mode, the desired settings relating to the operation of the copier can be selected by the user from the screen of the touch-panel display unit 121. For example, when the screen of FIG. 6A is indicated on the display unit 121, the user may depress the mode clear key 129 of the operation panel 122. After the mode clear is performed, the password is entered using the ten keys 125, and the screen of the display unit 121 changes to the screen of FIG. 6B.

Figure 6B:
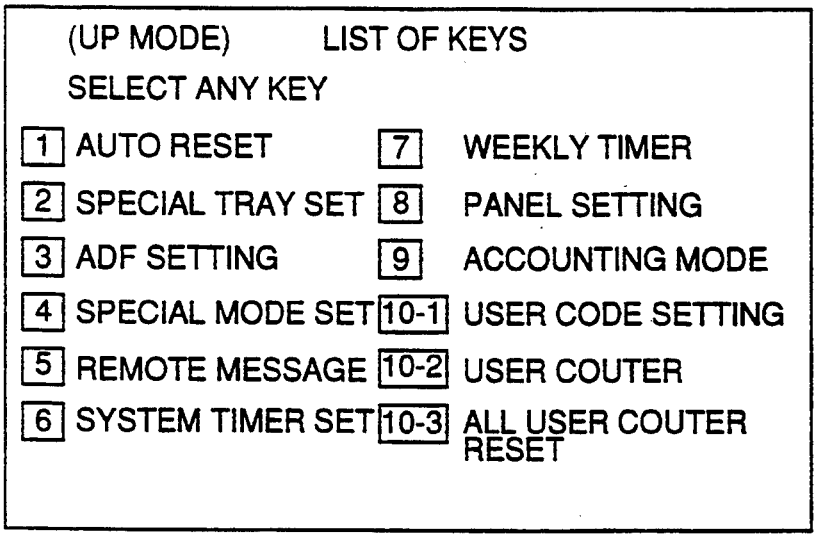
Figure 6C:
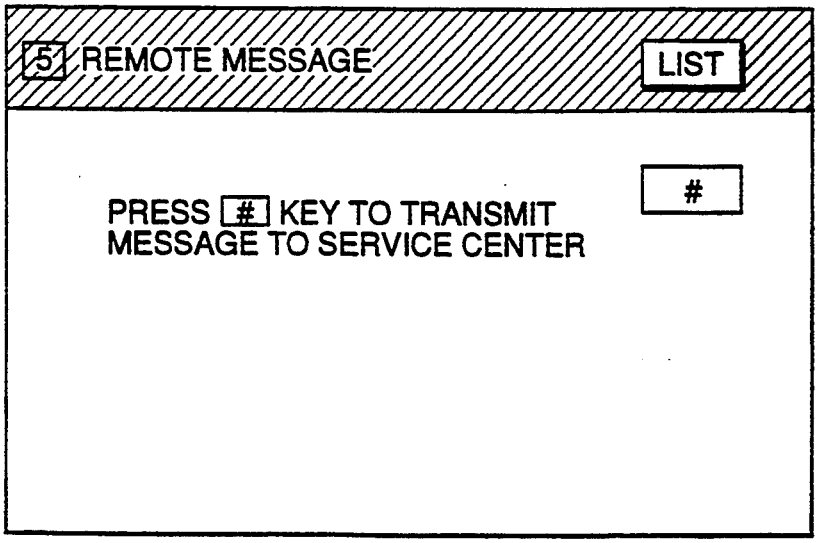

The screen of FIG. 6B is the up mode screen indicated by the touch-panel display unit 121 when the image forming unit is operated in the user programming mode. If the user depresses or touches the remote message key "5" on the screen of FIG. 6B, the CRT screen of the display unit 121 changes to the screen of FIG. 6C. The screen of FIG. 6C is the manual call mode screen indicated by the touch-panel display unit 121 when it is waiting for the user to transmit a remote message. If the user depresses or touches the "#" key on the screen, the remote message can be transmitted to the management unit located at a service center.

Figure 7:
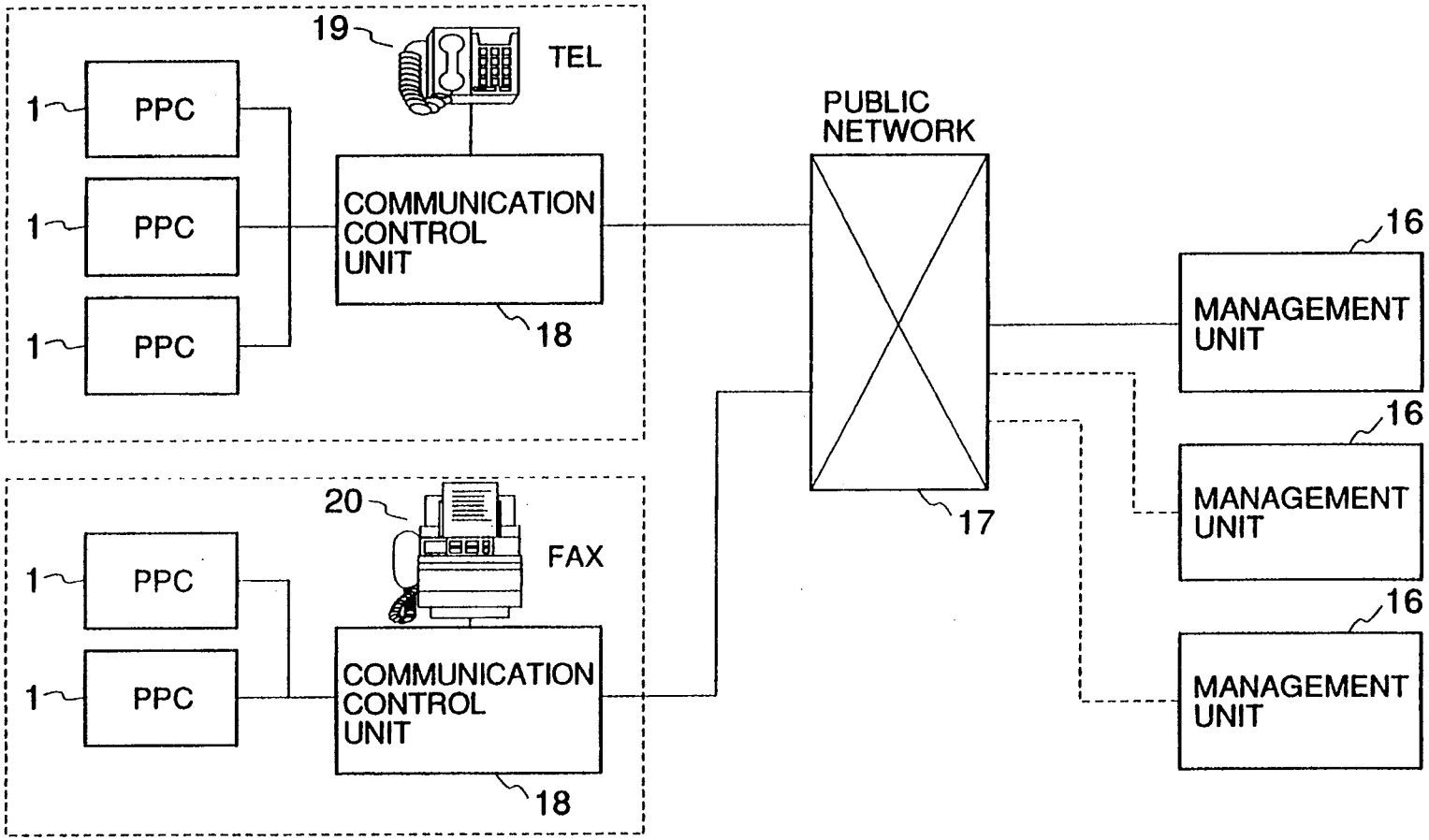
FIG. 7 is a block diagram showing an image forming unit management system to which the present invention is applied.

Next, a description will be given, with reference to FIGS. 7 through 10, of an image forming unit management system to which the present invention is applied. FIG. 7 shows the image forming unit management system according to the present invention. In FIG. 7, a plurality of image forming units 1 at user facilities are connected to a management unit 16 at a remote site via a public network 17.

As shown in FIG. 7, a communication control unit (CCU) 18 is installed at each of the user locations. The CCU 18 is connected to each of the image forming units 1 at the user location, and controls the communication between the image forming units 1 at the user location and a corresponding management unit 16 at the remote side via the public network 17. The existing telephone system 19 and the existing facsimile machine 20 at the user locations can be connected to the public communication line through the CCU 18. For this reason, the CCU 18 can be easily installed in user companies, offices and other facilities.

One or a plurality of image forming units can be connected to the communication control unit 18 by using a multi drop connection interface circuit which is in conformity with the known RS485 standard. It is not necessary that the image forming units are of the same type. Several image forming units of different types may be connected to the communication control unit 18.

The data transmission between each of the image forming units 1 and the CCU 18 is accomplished by performing a basic data transmission procedure. The CCU 18 serves as the central control station, and the data link is established by utilizing the centralized polling/selecting control method. Each of the image forming units 1 is identified by setting a specific address of an address switch provided within the CCU 18. The polling and selecting addresses to establish the data link for each of the image forming units 1 are determined based on the specific address of the address switch.

Figure 8:
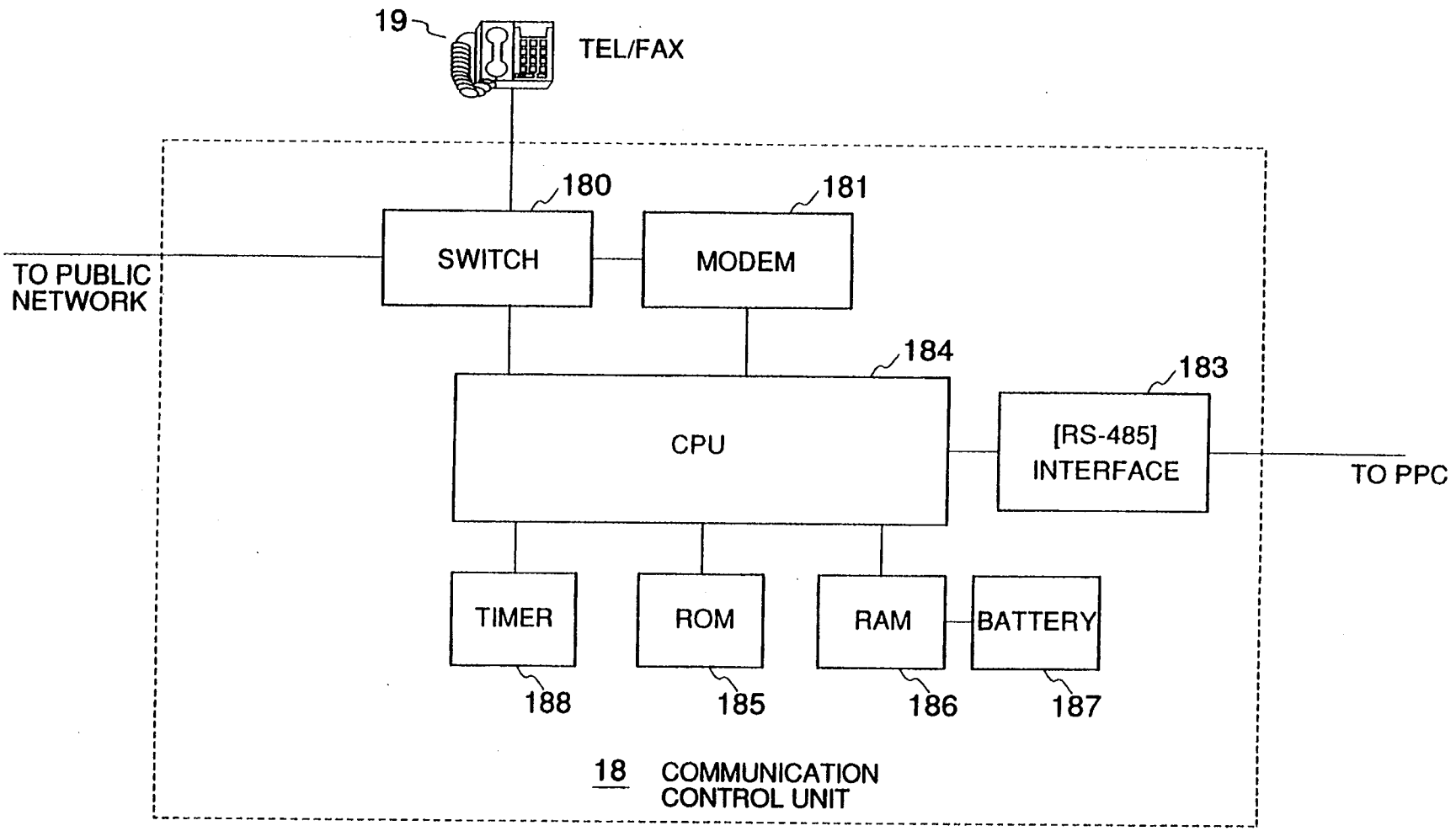
FIG. 8 is a block diagram showing a communication control unit of the image forming unit management system in FIG. 7.

FIG. 8 shows the communication control unit of the image forming unit management system in FIG. 7. In FIG. 8, the communication control unit (CCU) 18 comprises a switch part 180, a modem 181, a central processing unit (CPU) 184 and an interface circuit 183.

In the communication control unit 18 in FIG. 8, there are also provided a read only memory (ROM) 185, a random access memory (RAM) 186 with a battery 187, and a timer 188. These component parts and the CPU 184 are interchanged as shown in FIG. 8. The CCU 18 is connected to each of the image forming units (the PPC copiers) 1 via the interface circuit 183, and this interface circuit 183 employs an RS485 standard transceiver.

A transmission signal from the public network 17 is first input to the switch part 180 of the communication control unit 18. If the transmission signal is addressed to the telephone system 19 or the facsimile machine 20 connected to the CCU 18, the switch part 180 changes the switching to connect the public line to the telephone system 19 or the facsimile machine 20. If the transmission signal comes from the management unit 16 and is addressed to the PPC copier 1, the switch part 180 changes the switching to connect the public line to the CCU 18.

The communication control between each image forming unit 1 and the CCU 18 via the interface circuit 183 is carried out by the CPU 184 which executes a communication control program stored in the ROM 185. The data of intermediate processes and the transmission data are temporarily stored in the RAM 186 and they are read out and written to by the CPU 184. The other parameters and settings needed to request any desired action by the CCU 18 are stored, in advance, in the RAM 186.

The power is continuously supplied to the CCU 18 all the day so that the CCU 18 can communicate with any of the management units 16 at any moments. In order to retain the contents of the data stored in the RAM 186, the RAM 186 is provided with the battery 187. If a power failure occurs, the power is supplied to the RAM 186 by the battery 187.

Figure 9:
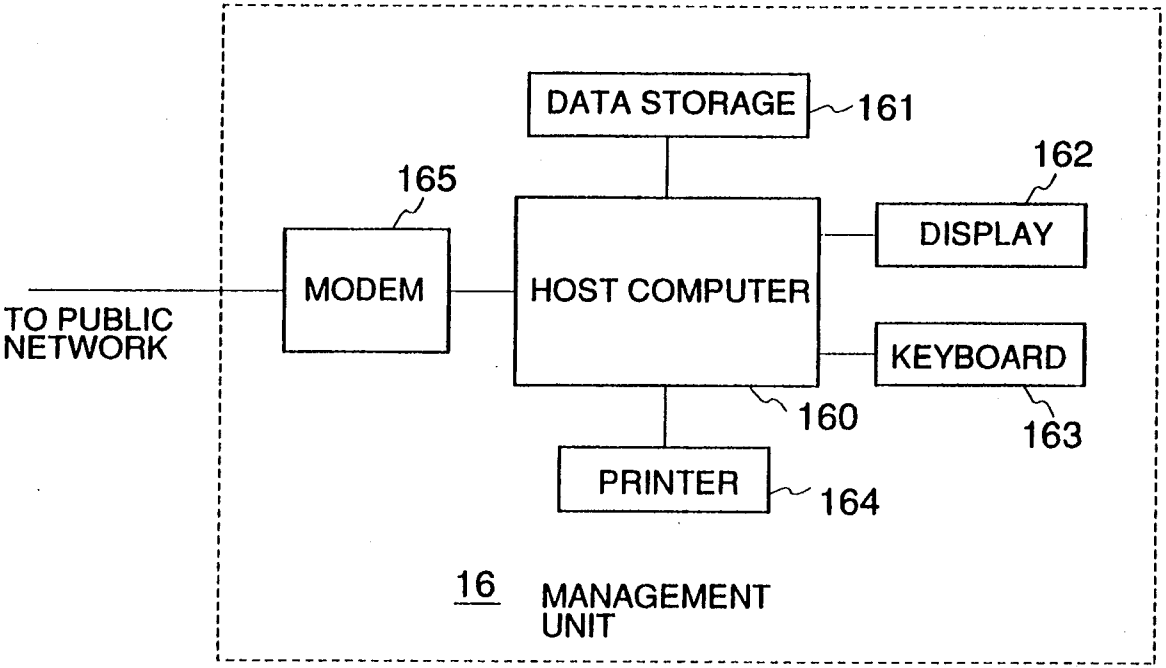
FIG. 9 is a block diagram showing a management unit of the image forming unit management system in FIG. 7.

FIG. 9 shows the management unit of the image forming unit management system in FIG. 7. In FIG. 9, the management unit 16 comprises a host computer 160, a data storage part 161, a display part 162, a keyboard 163, a printer 164, and a modem 165. The data storage part 161 is a magnetic disk device coupled to the host computer 160 for storing management data relating to the image forming units 1 and the other data. The display part 162 indicates on its CRT screen the data output from the host computer 160. The keyboard 163 is the operation part of the management unit 16. The printer 164 prints the data output from the host computer 160. The modem 165 is an interface circuit for connecting the public network 17 and the host computer 160.

Figure 10:
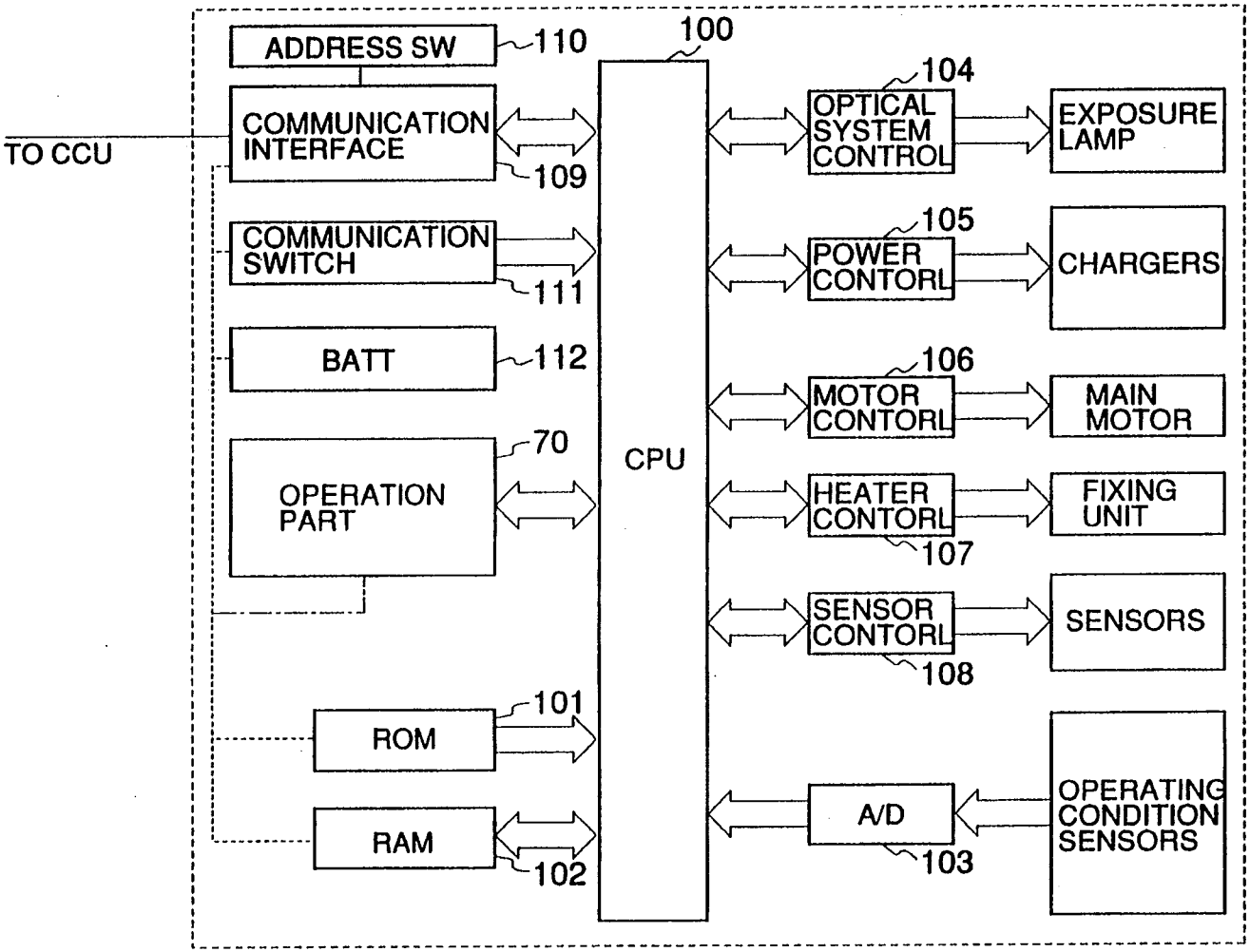
FIG. 10 is a block diagram showing a control part of the image forming unit in FIG. 7.

FIG. 10 shows the construction of a control part of the image forming unit in FIG. 7. In FIG. 10, the control part of the image forming unit (the PPC copier) 1 comprises a central processing unit (CPU) 100, a read only memory (ROM) 101, and a random access memory (RAM) 102. The operation of the image forming unit 1 is controlled by the CPU 100 which executes an operation control program stored in the ROM 101 in accordance with the prescribed settings. The data relating to intermediate processes and the other parameters are stored in the RAM 102.

In the image forming unit management system according to the present invention, one of a plurality of different message types is inputted by the user from the operation part of the image forming unit to specify the type of user message before the user message is transmitted from the image forming unit to the management unit. In order to allow the image forming unit management system (the image forming unit and the communication control unit) to recognize each of the message types, a plurality of message codes respectively indicating the plurality of message types are predetermined.

Thus, in the RAM 102 of the control part of the image forming unit 1, a plurality of predetermined message codes respectively indicating the plurality of available message types (e.g, a remote message key type, a self-diagnostic function type, a preliminary warning function type, and the others) are stored in advance. In addition, in the RAM 102 of the control part of the image forming unit 1, a set of data items indicating the number of jams, the number of troubles, the number of copies and a working condition of the image forming unit 1 are stored with respect to each of the plurality of available message types.

In the control part of the image forming unit 1 in FIG. 10, an analog-to-digital (A/D) converter 103 supplies a digital signal relating to the working condition of the copier to the CPU 100. The voltage output to the exposure lamp 22, the emitting light voltage and receiving light voltage output by the position sensor 45, the signal output by the electric potential sensor 39, the signal output by the document position sensor 8, the light quantity signal sensed from the exposure lamp 22, the drum current signal sensed from the photosensitive drum 35, and the thermistor voltage sensed from the fixing unit 65 are input to the A/D converter 103, and each of these signals is converted by the A/D converter 103 into a digital signal. This digital signal is supplied by the A/D converter 103 to the CPU 100.

In the control part of the image forming unit 1 in FIG. 10, an optical system control unit 104 controls the operation of the scanner unit 10 in FIG. 1. A power control unit 105 supplies a high voltage to each of the first charger 37, the separation charger 44, the transfer charger 43 and the pre-transfer charger 42. The power control unit 105 applies a bias voltage to the developing unit 40. A motor control unit 106 controls the operation of each of the photosensitive drum 35 and the transporting rollers. A heater control unit 107 controls the current supplied to the heater of the fixing unit 65 so that the temperature of the fixing roller of the fixing unit 65 is suitably adjusted. A sensor control unit 108 varies the gain of the light quantity sensor, the gain of the document set sensor 8, the gain of the position sensor 45, and the light emitting voltage of the position sensor 45.

In the control part in FIG. 10, a communication interface unit 109 connects the CPU 100 of the image forming unit 1 to the CCU 18. An address switch 110 sets a specific address of the image forming unit 1. In this embodiment, the specific addresses of the image forming units range from 1 to 5. A communication switch 111 (which is located outside the operation part 70) is turned ON to allow the data transmission between the image forming unit 1 and the CCU 18, and it is turned OFF to prohibit the data transmission between the image forming unit 1 and the CCU 18. A battery 112 supplies the electric power to each of the operation part 70, the CPU 100, the ROM 101, the RAM 102, the communication interface unit 109 and the communication switch 111. As the electric power is always supplied by the battery 112 to the RAM 102, the RAM 102 is called a backup RAM. If the power supply of the image forming unit 1 is switched off, the data and parameters stored in the backup RAM 102 can be retained.

Next, a description will be given, with reference to FIGS. 12A through 22, of several processes performed by the image forming unit management system according to the present invention.

Figure 12A:
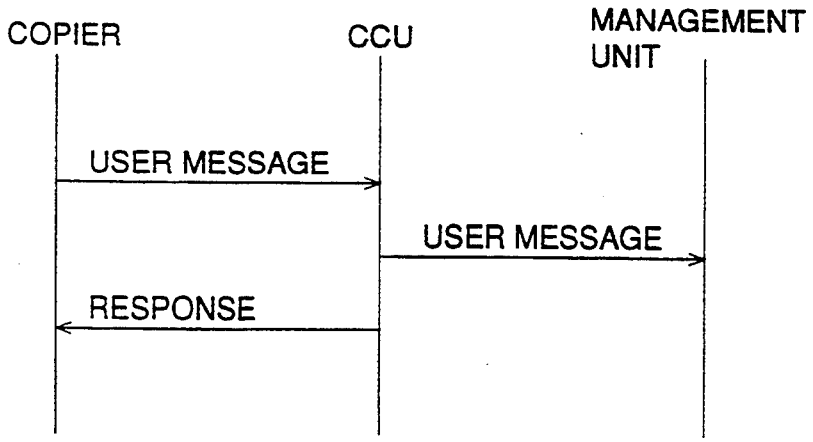
FIGS. 12A through 12C are charts for explaining remote message processes performed by the image forming unit management system.

FIG. 12A shows a remote message process performed by the image forming unit management system when the remote message key of the operation part 70 is depressed. If the remote message key is depressed, a user message is transferred from the image forming unit (the PPC copier) 1 to the communication control unit (CCU) 18.

After the CCU 18 receives the user message, the CCU 18 calls the management unit 16. The telephone number of the management unit 16 to be called is preset in the RAM 186 of the CCU 18. The user message received from the copier 1 includes several items of data, and, necessary items are selected by the CCU 18 from the items of the user message data. The selected items of data are previously set in the CCU 18 with respect to the management unit 16. In other words, the items of the user message data transmitted by the CCU 18 to the management unit 16 are only the items of data used by the management unit 16. The setting of the CCU 18 regarding the selected items of data can be modified by the management unit 16 through the data transmission via the public network 17.

After the connection between the CCU 18 and the management unit 16 is established, the CCU 18 transmits the user message to the management unit 16 via the public network 17. After the transmission is finished, the CCU 18 transfers a response message to the image forming unit 1. The response message received by the image forming unit 1 indicates that the transmission of the user message from the CCU 18 to the management unit 16 is normally completed, or that the transmission abnormally ends.

The image forming unit 1 usually has a self-diagnostic function. With the self-diagnostic function of the image forming unit 1, an error message or a preliminary warning message is indicated if the image forming unit 1 malfunctions or has a problem. The malfunctions of the image forming unit 1 detected by the self-diagnostic function are a high fixing unit temperature, an incapable voltage adjustment, a critical copier trouble and the others. The problem has a likeness to the malfunction but is not serious to the operation of the copier.

Figure 12B:
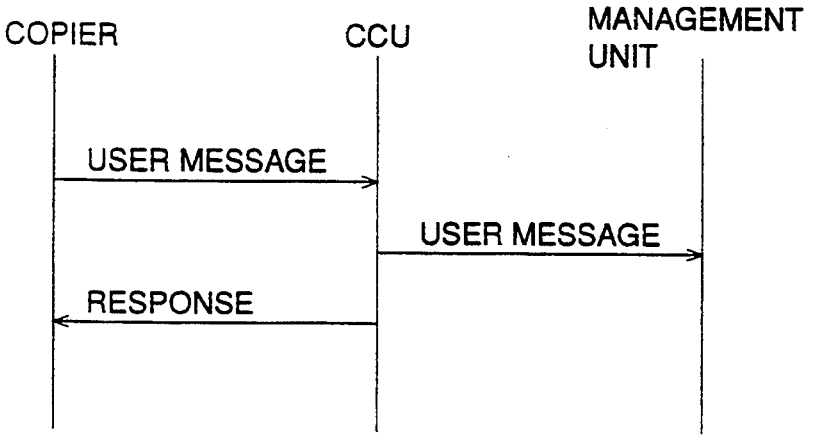

FIG. 12B shows a remote message process performed by the image forming unit management system of the present invention when any malfunction of the image forming unit 1 is detected by the self-diagnostic function so that an error message is indicated. At this time, a user message that indicates the malfunction detected is transferred from the image forming unit 1 to the CCU 18, similarly to the remote message process of FIG. 12A. After the CCU 18 receives the user message, the CCU 18 transmits the user message to the management unit 16 via the public network 17. After the transmission is finished, the CCU 18 transfers a response message to the image forming unit 1. The image forming unit 1 does not work if a malfunction is detected by the self-diagnostic function.

Figure 12C:
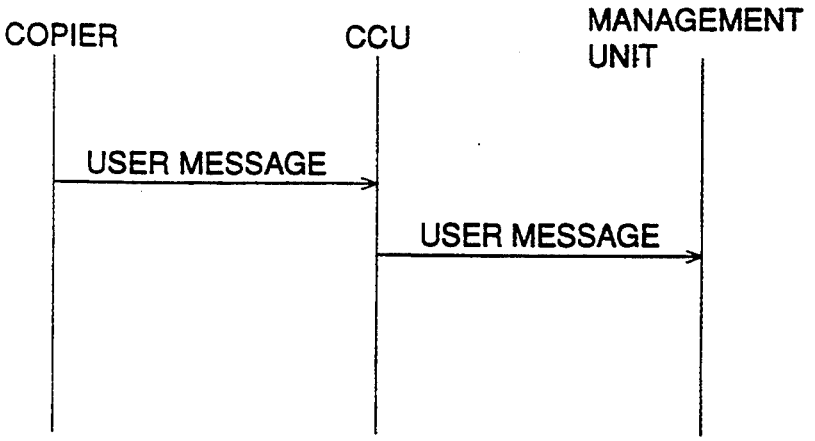

FIG. 12C shows a remote message process performed by the image forming unit management system of the present invention when any problem of the image forming unit 1 is detected by the self-diagnostic function so that a preliminary warning is indicated. At this time, a user message that indicates the problem detected is transferred from the image forming unit 1 to the CCU 18. After the CCU 18 receives the user message, the CCU 18 transmits the user message to the management unit 16 via the public network 17. After the transmission is finished, no response message is transferred from the CCU 18 to the image forming unit 1. The image forming unit 1 may operate if a problem is detected by the self-diagnostic function.

When the CCU 18 is operating in a busy condition, or it is heavily loaded with the operation of the image forming units 1 or with the operation of the telephone system 19 or the facsimile machine 20, the CCU 18 does not necessarily transmit the user message to the management unit 16 immediately after the CCU 18 receives the user message. The time of the transmission of the user message by the CCU 18 can be set to an appropriate time. It is desirable that the user message is transmitted from the CCU 18 to the management unit 16 when the traffic of the communication line is relatively light or when the telephone system 19 or the facsimile machine 20 is not frequently used.

The setting of the CCU 18 regarding the transmission time of the user message can be modified by the management unit 16 through the data transmission. With the function of the timer 188, the CCU 18 may transmit the user message to the management unit 16 at the transmission time set by the management unit 16.

Figure 13A:
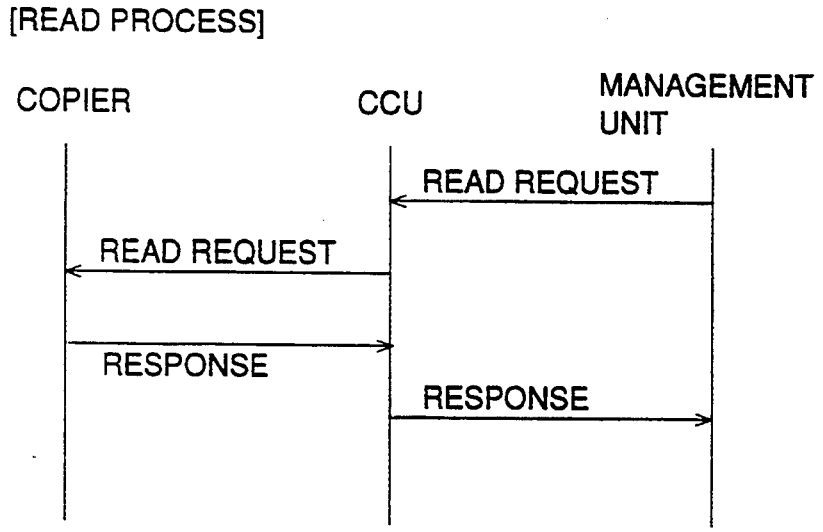
FIGS. 13A through 13C are charts for explaining read, write and execute processes performed by the image forming unit management system between the image forming unit and the management unit.

FIG. 13A shows a read process performed by the image forming unit management system of the present invention. The management unit 16 can gain access to the image forming unit 1 through the CCU 18 to read a user message from the image forming unit. The user message read out by the management unit 16 includes the copier logging data, the control signal setting, and the sensor output voltage data.

In FIG. 13A, the management unit 16 calls the CCU 18 to which the image forming unit 1 of interest is connected. After the connection between the management unit 16 and the CCU 18 is established, the management unit 16 transmits a read request to the CCU 18 via the public network 17. After the CCU 18 receives the read request, the CCU 18 transfers the read request to the image forming unit 1.

If the image forming unit 1 receives the read request, the image forming unit 1 transfers a response that indicates the requested matter such as the copier logging data to the CCU 18. After the CCU 18 receives the response, the CCU 18 transmits the response to the management unit 16 via the public network 17. As the management unit 16 receives the response including the requested matter from the image forming unit 1, the read process is completed.

Figure 13B:
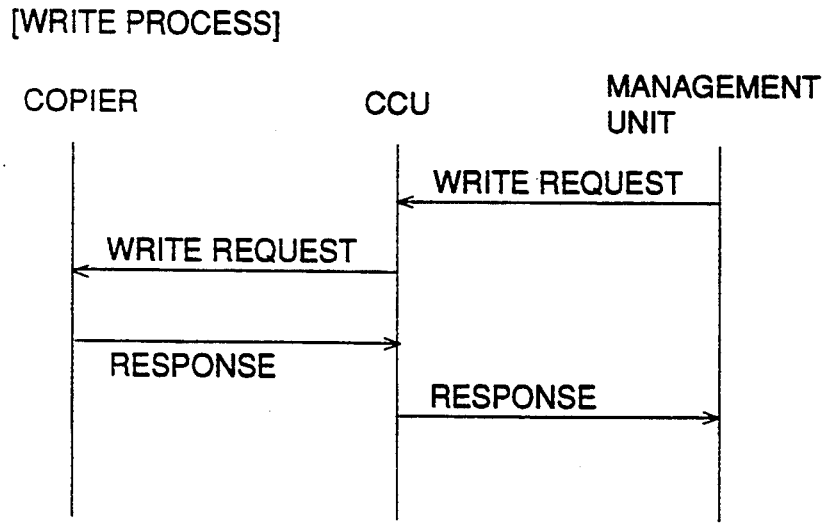

FIG. 13B shows a write process performed by the image forming unit management system of the present invention. The management unit 16 can modify the parameter setting of the image forming unit 1 of interest through the data transmission. The procedures of the write process in FIG. 13B are similar to those of the read process in FIG. 13A described above. When the write process is performed, the management unit 16 receives from the image forming unit 1 of interest a response indicating whether the writing of the modified parameter setting to the image forming unit 1 is normally completed or it abnormally ends.

Figure 13C:
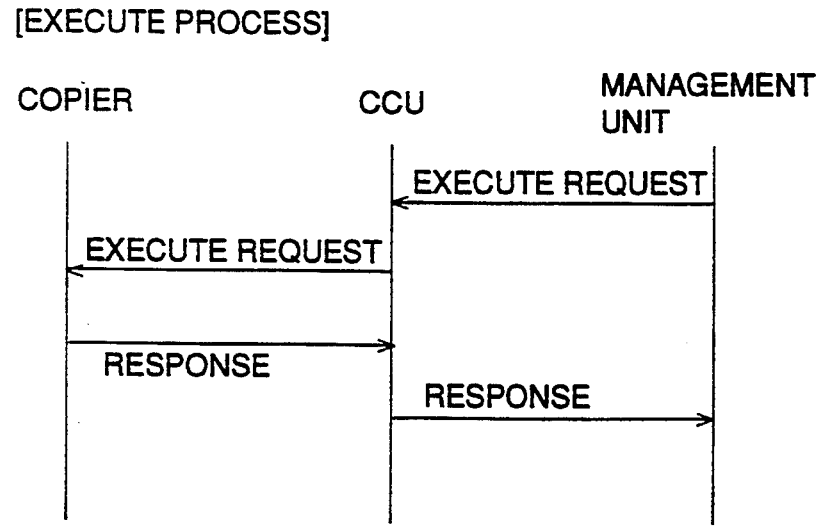

FIG. 13C shows an execute process performed by the image forming unit management system of the present invention. The management unit 16 can execute a test to check the operation of the image forming unit 1 of interest through the data transmission. The procedures of the execute process in FIG. 13C are similar to those of the read process in FIG. 13A described above. When the execute process is performed, the management unit 16 receives a response indicating the result of the executed test from the image forming unit 1 via the public network 16.

Figure 14A:
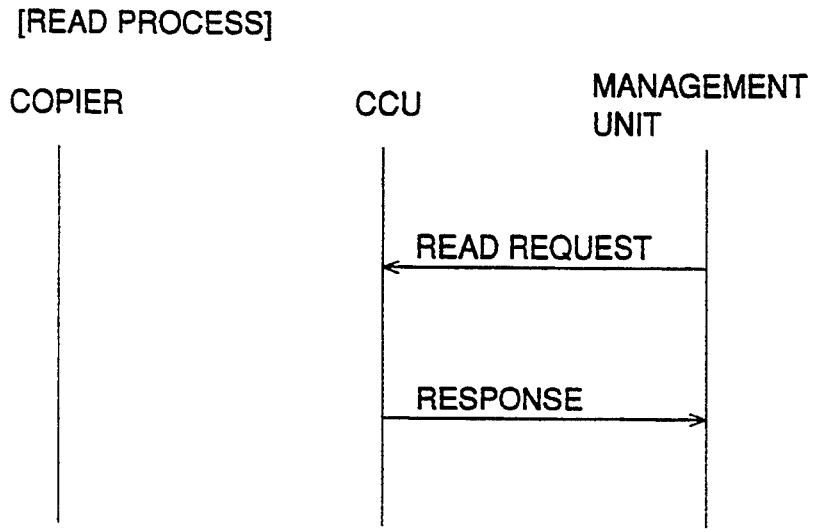
FIGS. 14A, 14B and 14C are charts for explaining read, write and execute processes performed by the image forming unit management system between the communication control unit and the management unit.
Figure 14B:
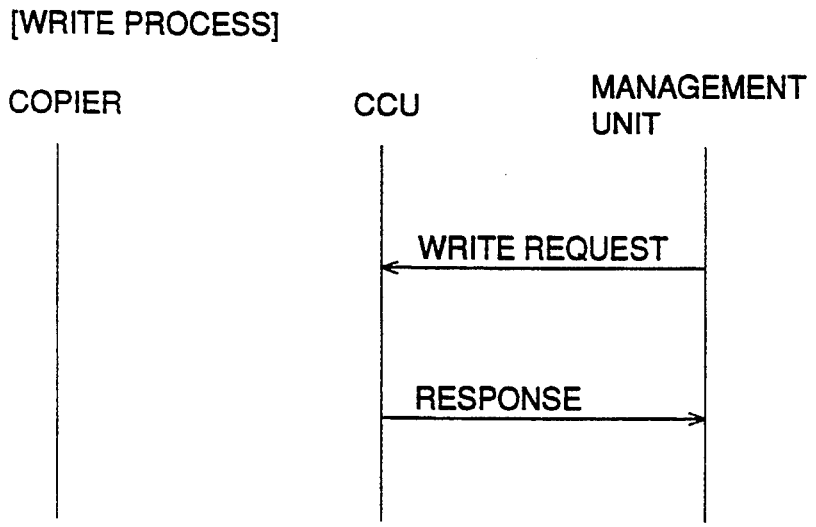
Figure 14C:
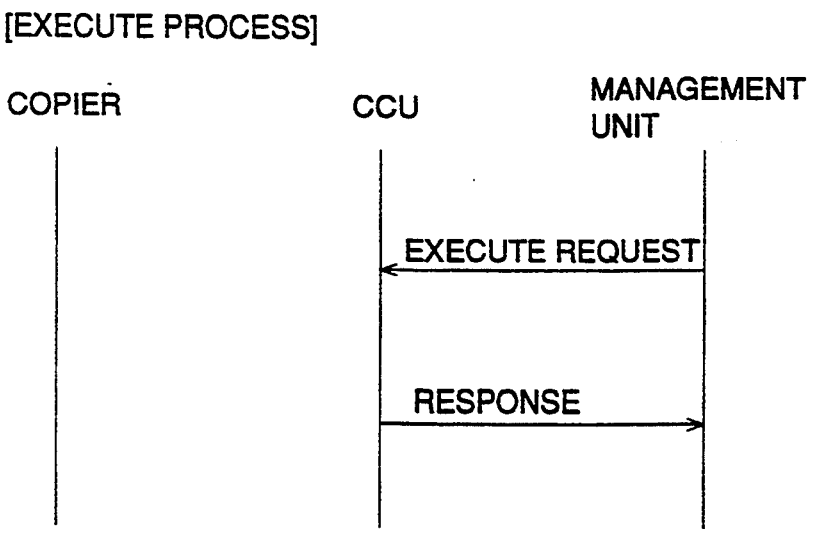

FIGS. 14A, 14B and 14C respectively show read, write and execute processes between the CCU and the management unit performed by the image forming unit management system. The management unit 16 can gain access to the CCU 18 through the public network 17 by performing a given communication procedure. When the read process in FIG. 14A is performed, a read request is transmitted from the management unit 16 to the CCU 18 via the public network 17. After the CCU 18 receives the read request from the management unit 16, the CCU 18 transmits to the management unit 16 a response message indicating the CCU parameter setting or the CCU working condition.

The management unit 16 can modify the parameter setting of the CCU 18 through the data transmission. When the write process in FIG. 14B is performed, a write request is transmitted from the management unit 16 to the CCU 18 via the public network 17. The management unit 16 receives from the CCU 18 a response indicating whether the writing of the modified CCU parameter setting to the CCU 18 is normally completed or it abnormally ends.

The management unit 16 can execute a test to check the operation of the CCU 18 through the data transmission. When the execute process in FIG. 14C is performed, an execute request is transmitted from the management unit 16 to the CCU 18 via the public network 17. The management unit 16 receives a response indicating the result of the executed test from the CCU 18 via the public network 17..

Figure 15:
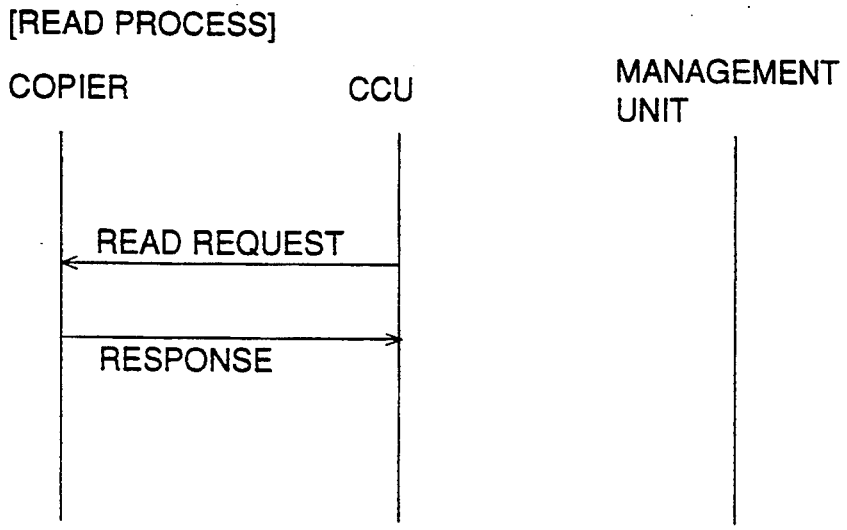
FIG. 15 is a chart for explaining a read process performed by the image forming unit management system between the image forming unit and the communication control unit.

FIG. 15 shows a read process performed by the image forming unit management system between the CCU and the image forming unit. The CCU 18 can gain access to the image forming unit 1 of interest. When the read process in FIG. 15 is performed, a read request is transferred from the CCU 18 to the image forming unit 1. The CCU 18 receives from the image forming unit 1 a response indicating the copier logging data, the control signal setting, and the sensor output voltage data. These items of data received by the CCU 18 will be transmitted to the management unit 16 via the public network 17 later upon request.

FIG. 16 shows the parameter settings in the communication control unit in FIG. 8. As shown in FIG. 16, the machine type and the serial number, which are specific to each of the plurality of the image forming units connected to the CCU 18, are preset in the CCU 18. When the CCU 18 receives a user message from the image forming unit 1, the CCU 18 adds the machine type and serial number of the image forming unit 1 of interest to the user message, and transmits the user message to the management unit 16 via the public network 17. When the CCU 18 receives a message from the management unit 16 via the public network 17, the CCU 18 sets the specific address of the image forming unit 1 of interest based on the received message in accordance with the parameters preset in the CCU 18.

In FIG. 16, the recipient telephone number, the number of re-dialing tries and the re-dialing intervals, which are specific for each of three types of user messages, are stored in the CCU 18. The transmission data including the number of jams, the number of troubles, the number of copies and the copier condition are stored in the CCU 18 with respect to each of three types of user messages. The transmission time at which the message is transmitted to the management unit is preset in the CCU 18 for the preliminary warning case only. These parameters are added to the user message if they are applicable, and the CCU 18 transmits the user message to the management unit 16 via the public network 17. As shown in FIG. 16, a check sum is preset in the CCU 18 for each group of the parameters. With the check sum, it is possible to detect whether the parameters added to the user message are erroneously varied or lost due to the malfunction of the CCU 18 or the exhaust of the battery. The parameter settings of the CCU 18 shown in FIG. 16 may be modified by the management unit 16 through the data transmission.

Figure 17A:
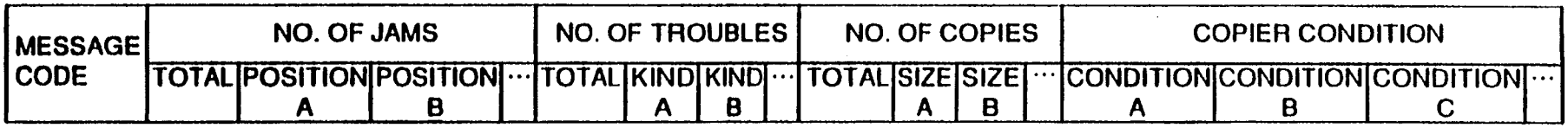
FIG. 17 is a diagram showing the data format of messages when a remote message process is performed.
Figure 17B:
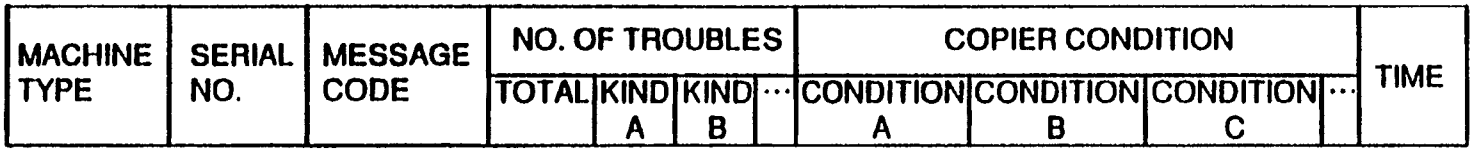
Figure 17C:
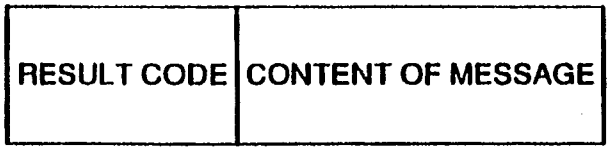

FIG. 17 shows the data format of messages used when a remote message process is performed. The data format of the user message from the image forming unit (the PPC copier) 1 to the communication control unit (CCU) 18 is indicated at the column (a) in FIG. 17. The first entry of this data format is the message code, and the message code indicates the type of the user message. With the message code, it can be detected whether the user message is transmitted by the remote message key, by the self-diagnostic function, or by the preliminary warning function. The following entries of the data format are the transmission data to be transmitted to the management unit 16. The copier condition included in the subsequent entries indicates the condition of the supply of copy sheets, toner cartridges or oil, the condition of the sensor output voltage data, the condition of the adjustment control setting, and the condition of the unit connections.

The data format of the user message from the CCU 18 to the management unit 16 is indicated at the column (b) in FIG. 17. The first and second entries of this data format are the machine type and the serial number of the image forming unit 1 of interest. The last entry of the data format is the time of occurrence of the user message which is set by using the timer 188 of the CCU 18. The data format of the response message from the CCU 18 to the PPC copier 1 after the transmission is finished is indicated at the column (c) in FIG. 17. The result code and the content of the response message are included in this data format.

Figure 18:
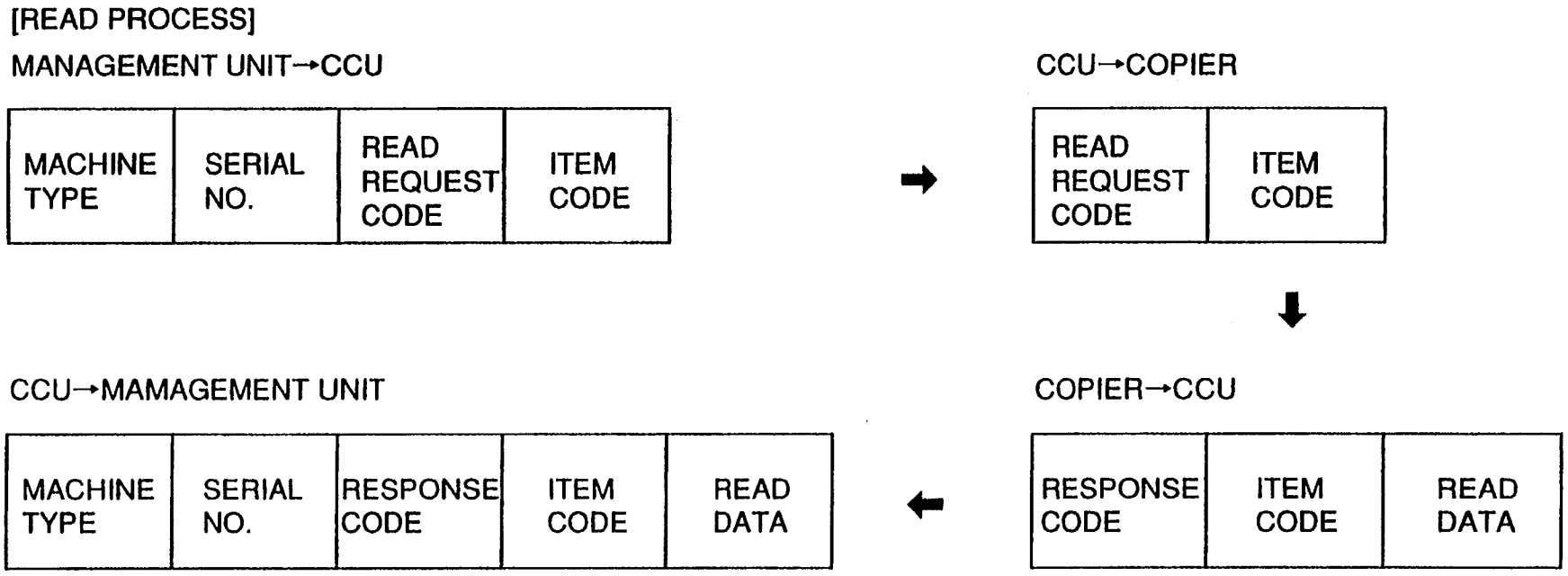
FIG. 18 is a diagram showing the data format of messages when the read process is performed.

FIG. 18 shows the data format of messages used when a read process is performed in order for the management unit 16 to read a user message from the image forming unit 1 through the CCU 18. The machine type, the serial number, the read request code, and the item code are the entries of the read request from the management unit 16 to the CCU 18. The machine type and the serial number indicate the image forming unit 1 of interest from which a user message is to be read by the management unit 16. The read request code indicates that the request of the read process is made by the management unit 16. The item code indicates which items of the copier related data are to be read.

The entries of the read request message from the CCU 18 to the image forming unit 1 are the read request code and the item code only. The machine type and the serial number are eliminated from the read request message. The entries of the response message from the image forming unit 1 to the CCU 18 are the response code, the item code, and the requested data that is read from the image forming unit 1. The entries of the response message from the CCU 18 to the management unit 16 are the machine type, the serial number, the response code, the item code, and the requested data. That is, the machine type and the serial number are added to the response message received from the image forming unit 1, and the CCU 18 transmits the response message including the added items to the management unit 16.

Figure 19:
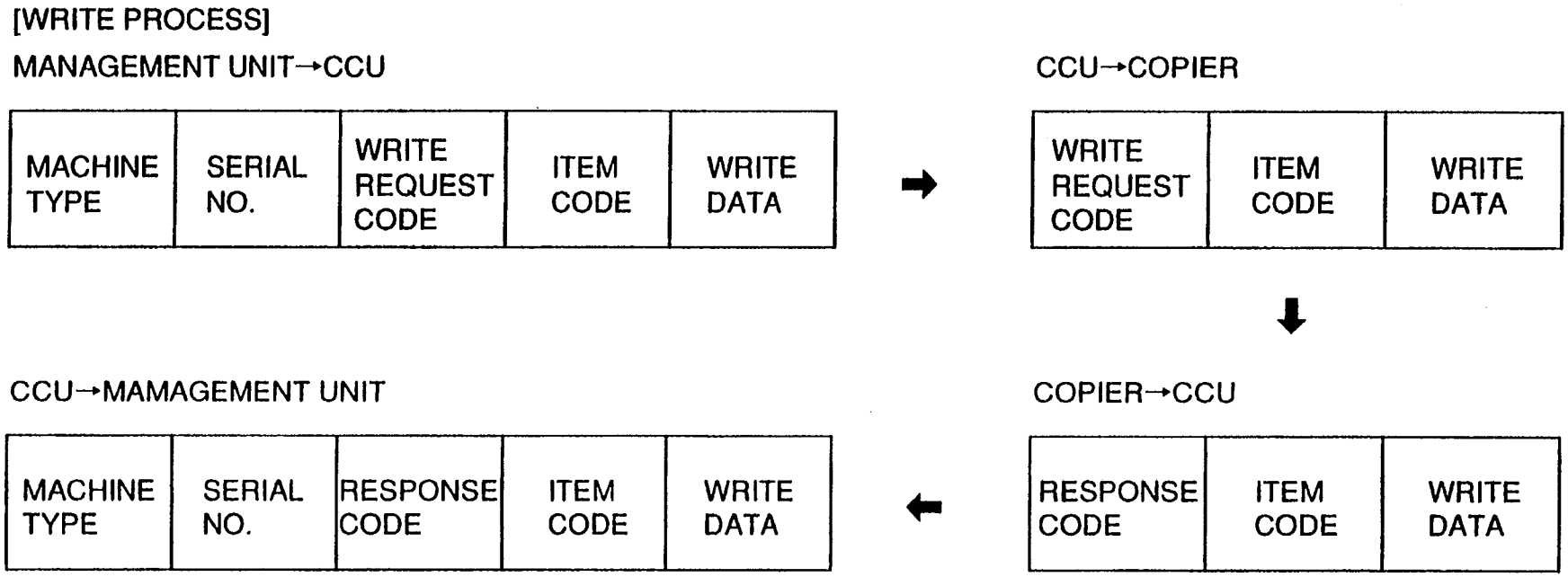
FIG. 19 is a diagram showing the data format of messages when the write process is performed.

FIG. 19 shows the data format of messages used when a write process is performed in order for the management unit 16 to write a message from the management unit 16 onto the image forming unit 1 through the CCU 18. The entries of the write request from the management unit 16 to the CCU 18 are the machine type, the serial number, the write request code, the item code, and the transmission data. The entries of the write request from the CCU 18 to the image forming unit 1 are the write request code, the item code and the transmission data. The entries of the response message from the image forming unit 1 to the CCU 18 are the response code, the item code, and the transmission data written to the image forming unit 1. The entries of the response message from the CCU 18 to the management unit 16 are the machine type, the serial number, the response code, the item code, and the transmission data written to the image forming unit 1. The transmission data of the transmitting write request message does not necessarily accord with the transmission data of the received response message.

Figure 20:
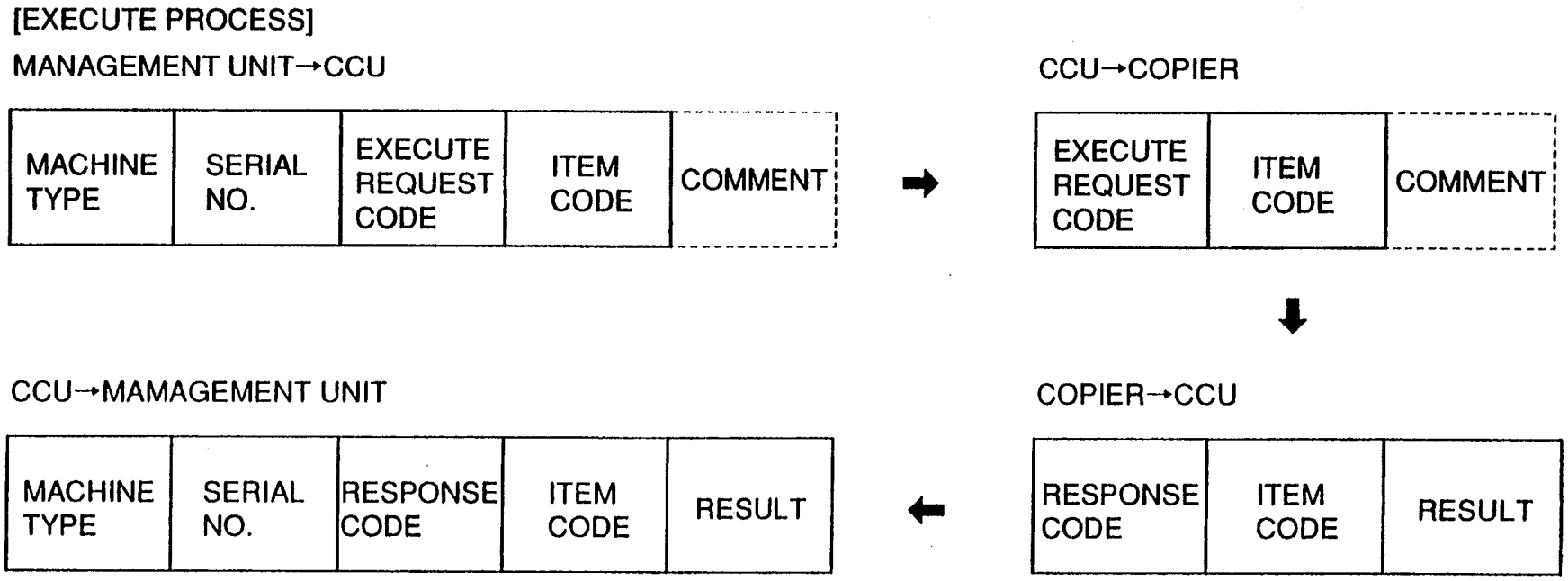
FIG. 20 is a diagram showing the data format of messages when the execute process is performed.

FIG. 20 shows the data format of messages used when an execute process is performed in order for the management unit 16 to execute a test to check the operation of the image forming unit 1 of interest through the data transmission. The entries of the user message from the management unit 16 to the CCU 18 include the comment in addition to the entries of the user message in FIG. 18. The comment is the data describing the operation of the image forming unit 1 to be checked by executing the test. After the test requested from the management unit 16 is finished, the response message indicating the result of the test is transmitted from the image forming unit 1 to the management unit 16 via the CCU 18.

FIG. 21 shows the data format of messages used when the read, write and execute processes between the CCU 18 and the management unit 16 are performed. The column (a) in FIG. 21 indicates the data format of the read request and response messages used when the read process between the CCU 18 and the management unit 16 is performed. The column (b) in FIG. 21 indicates the data format of the write request and response messages used when the write process between the CCU 18 and the management unit 16 is performed. The column (c) in FIG. 21 indicates the data format of the execute request and response messages when the execute process between the CCU 18 and the management unit 16 is performed. The entries of the data format of the messages in FIG. 21 are the same as the entries of the data format of the messages in FIGS. 18 through 20 when the read, write and execute processes between the CCU 18 and the management unit 16 are performed, except that the CCU code with respect to the CCU 18 is used in the data format instead of the machine type and serial number with respect to the image forming unit 1.

Figures 22, 23:
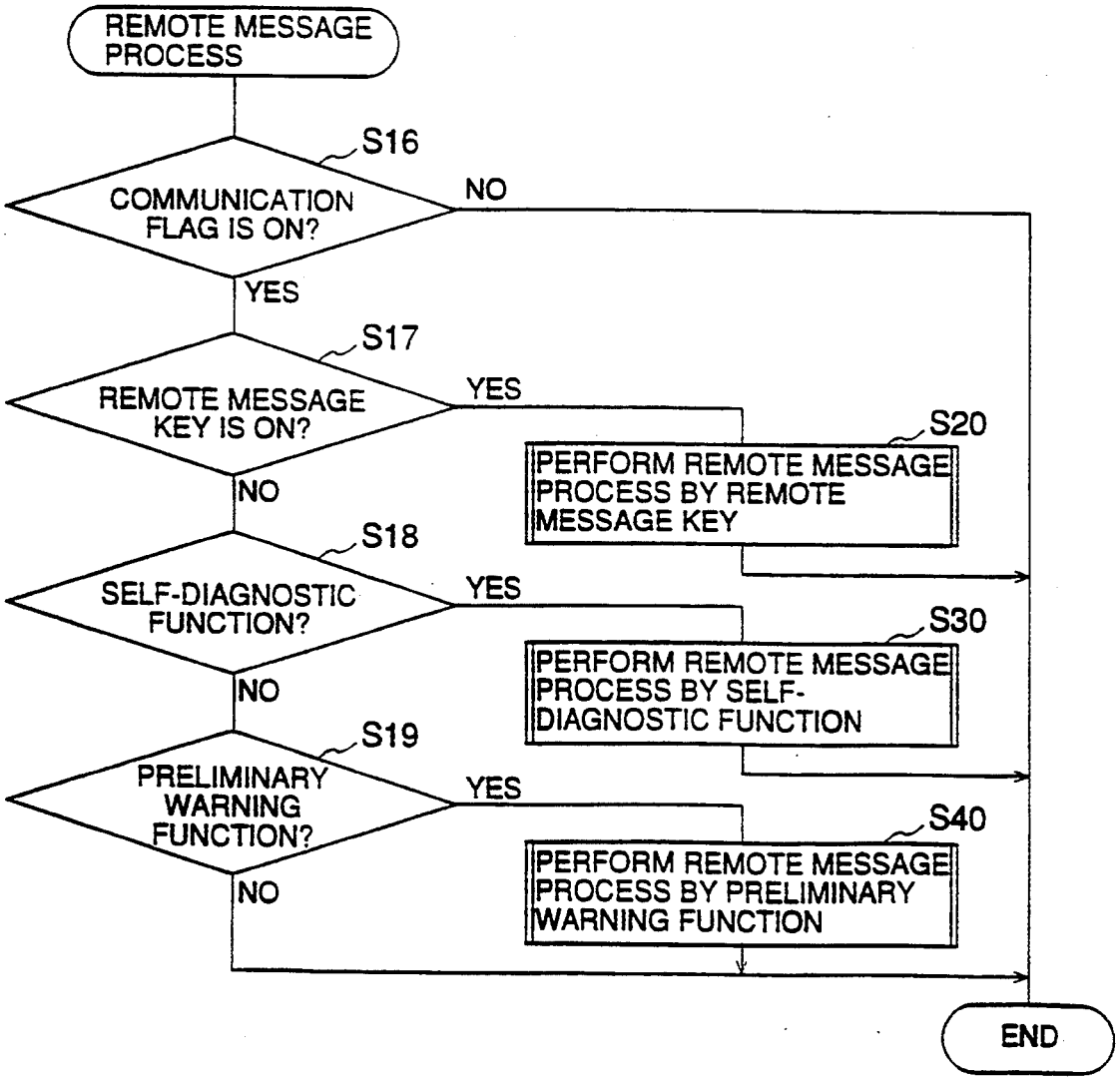
FIG. 22 is a diagram showing the data format of messages when a read process between the image forming unit and the communication control unit is performed.
FIG. 23 is a flow diagram for explaining a main routine of the remote message process performed by the control part of the image forming unit.

FIG. 22 shows the data format of the read request and response messages used when the read process between the image forming unit 1 and the CCU 18 is performed. The entries of the read request message from the CCU 18 to the image forming unit 1 are the read request code and the item code. The entries of the response message from the image forming unit 1 to the CCU 18 are the read response code, the item code, and the read data. These entries are the same as the entries of the messages between the image forming unit 1 and the CCU 18 indicated in FIG. 18. In the case of the read process between the CCU 18 and the image forming unit 1, it is not necessary for the management unit 16 to gain access to the image forming unit 1.

Next, a description will be given, with reference to FIGS. 23 through 30, of the detailed procedures of several processes performed by the control art of the image forming unit.

FIG. 23 shows a main routine of the remote message process performed by the control part (the CPU 100) of the image forming unit of interest. This remote message process is performed with the operation part 70 in FIG. 2. In the main routine in FIG. 23, the control part of the image forming unit 1, at step S16, detects whether or not the communication switch 111 in FIG. 10 is turned ON to allow the data transmission between the image forming unit 1 and the CCU 18. The communication switch 111 is located outside the operation part 70.

If the result at step S16 is affirmative, step S17 detects whether or not the remote message key 83 of the operation part 70 is turned ON. If the result at step S17 is affirmative, step S20 performs the above described remote message process of FIG. 12A by the remote message key 83.

If the result at step S17 is negative, step S18 is performed. Step S18 detects whether or not a malfunction in the image forming unit 1 is detected by the self-diagnostic function. If the result at step S18 is affirmative, step S30 performs the above mentioned remote message process of FIG. 12B by the self-diagnostic function.

If the result at step S18 is negative, step S19 is performed. Step S19 detects whether or not a problem in the image forming unit 1 is detected by the preliminary warning function. If the result at step S19 is affirmative, step S40 performs the above described remote message process of FIG. 12C by the preliminary warning function.

If the result at step S16 is negative, or if the result at step S19 is negative, or if one of the three remote message processes at steps S20, S30 and S40 is finished, the main routine in FIG. 23 is finished.

Figure 24:
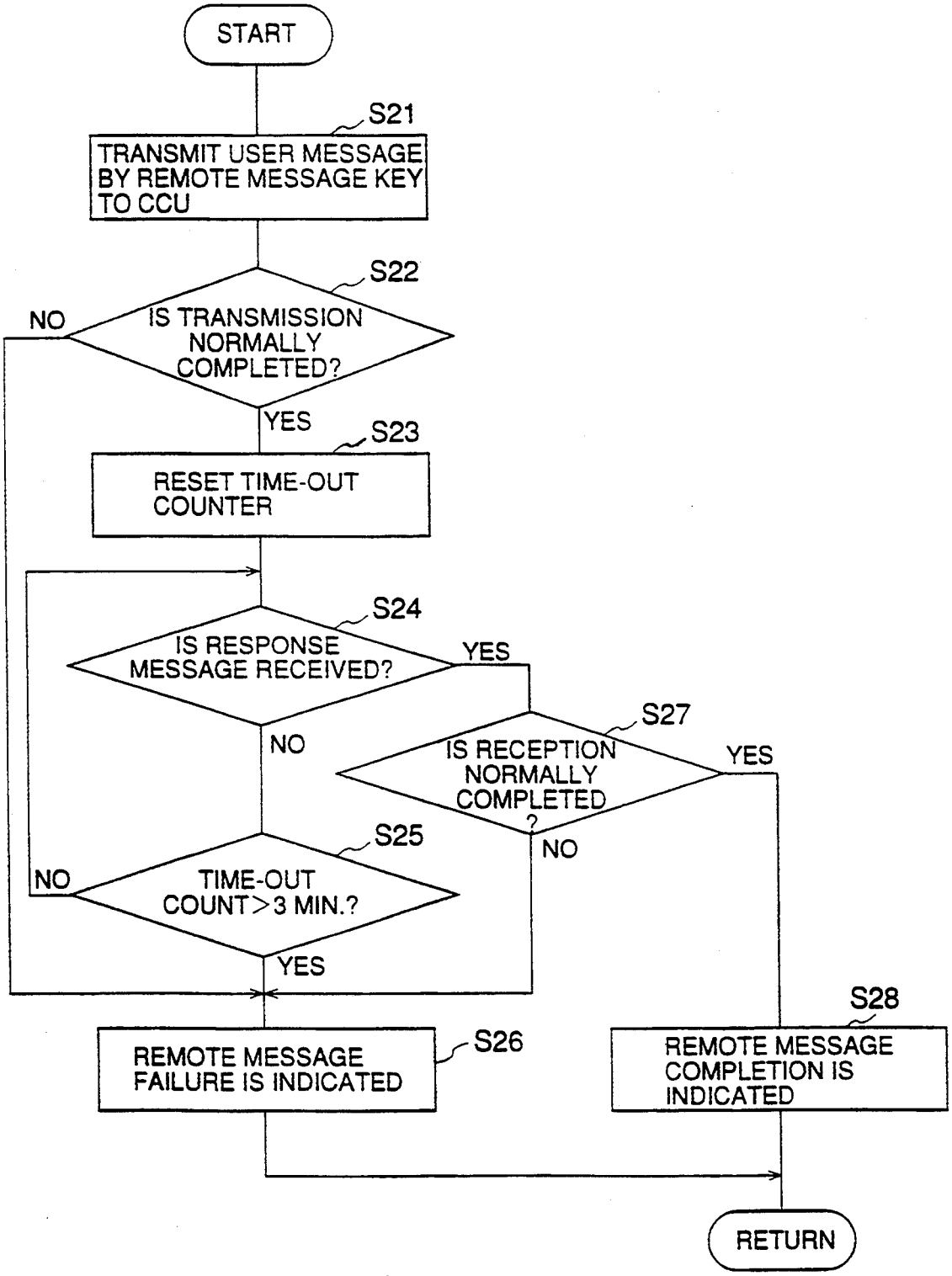
FIG. 24 is a flow diagram for explaining a sub-routine of a remote message key process in the main routine in FIG. 23.

FIG. 24 shows a sub-routine of the remote message process in the main routine in FIG. 23. This sub-routine corresponds to the above step S20 of the main routine in FIG. 23. In FIG. 24, the control part of the image forming unit 1, at step S21, transmits a user message generated by the remote message key to the CCU 18. Step S22 detects whether or not the transmission of the user message is normally completed.

If the result at step S22 is affirmative, step S23 is performed. Step S23 resets a time-out counter to zero. This time-out counter is automatically incremented since the resetting is done, and it is used to check if the transmission of the user message from the image forming unit 1 to the CCU 18 and the reception of the response to the user message are completed within a given time period. Step S24 detects whether or not the response to the user message is received by the image forming unit 1 from the CCU 18.

If the result at step S24 is negative, step S25 detects whether or not the count of the time-out counter exceeds 3 minutes. If the result at step S25 is negative, the above step S24 is repeated. On the other hand, if the result at step S25 is affirmative, step S26 is performed. Thus, when the response from the CCU 18 is not received by the image forming unit 1 within 3 minutes, step S26 switches ON the remote message alarm indicator D8 of the operation part 70 to indicate that the remote message transmission by the remote message key 83 has failed.

If the result at step S22 is negative, the above step S26 is performed to switch ON the remote message alarm indicator D8 to indicate the failure of the remote message transmission by the remote message key 83.

If the result at step S24 is affirmative, step S27 is performed. Step S27 detects whether or not the reception of the response from the CCU 18 is normally completed. If the result at step S27 is negative, the above step S26 is performed. If the result at step S27 is affirmative, step S28 is performed. Step S28 indicates the completion of the remote message transmission by the remote message key 83. This message at step S28 is indicated in the guidance display part 71 of the operation part 70 in FIG. 2.

Figure 25:
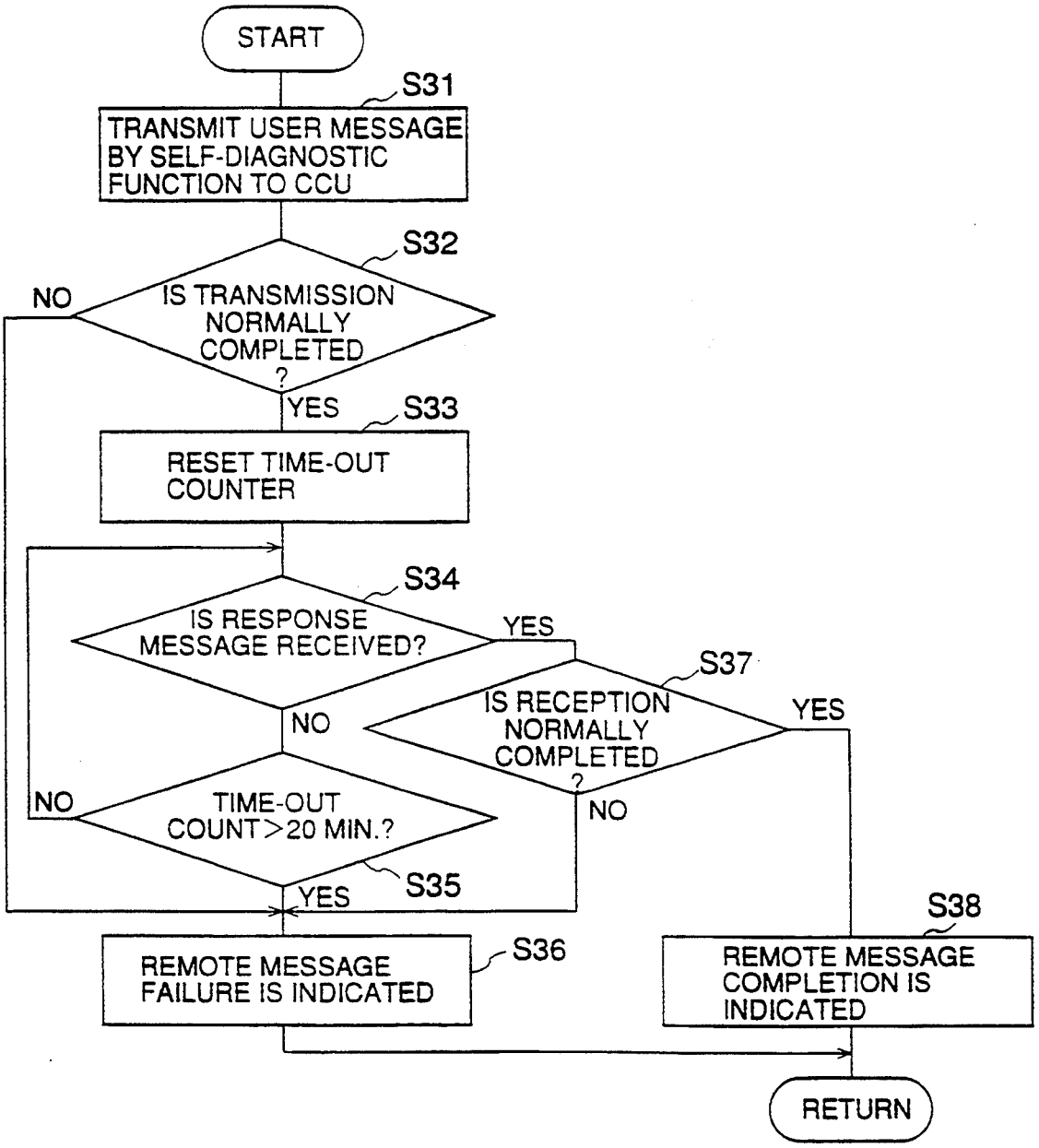
FIG. 25 is a flow diagram for explaining a sub-routine of a self-diagnostic function process in the main routine in FIG. 23.

FIG. 25 shows a sub-routine of the remote message process by the self-diagnostic function in the main routine in FIG. 23. This sub-routine corresponds to the step S30 of the main routine in FIG. 23. Steps S31 through S38 of the sub-routine in FIG. 25 are the same as the above described steps S21 through S28 of the sub-routine in FIG. 24, except that the time limit of the reception of a response from the CCU 18 by the image forming unit 1 in FIG. 25 is 20 minutes, and that a user message generated by the self-diagnostic function is transmitted from the image forming unit 1 to the CCU 18. Thus, a description of these steps in FIG. 25 will be omitted.

Figure 26:
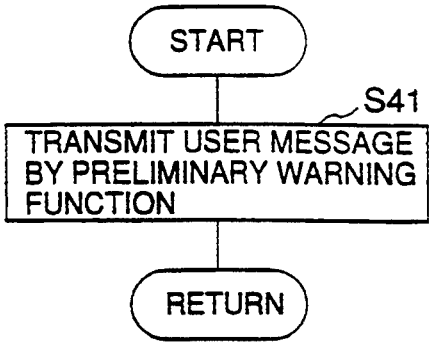
FIG. 26 is a flow diagram for explaining a sub-routine of a preliminary warning function process in the main routine in FIG. 23.

FIG. 26 shows a sub-routine of the remote message process by the preliminary warning function process in the main routine in FIG. 23. This sub-routine corresponds to the step S40 of the main routine in FIG. 23. In FIG. 26, the control part of the image forming unit, at step S41, transmits a user message generated by the preliminary warning function is transmitted from the image forming unit 1 to the CCU 18.

Figure 27:
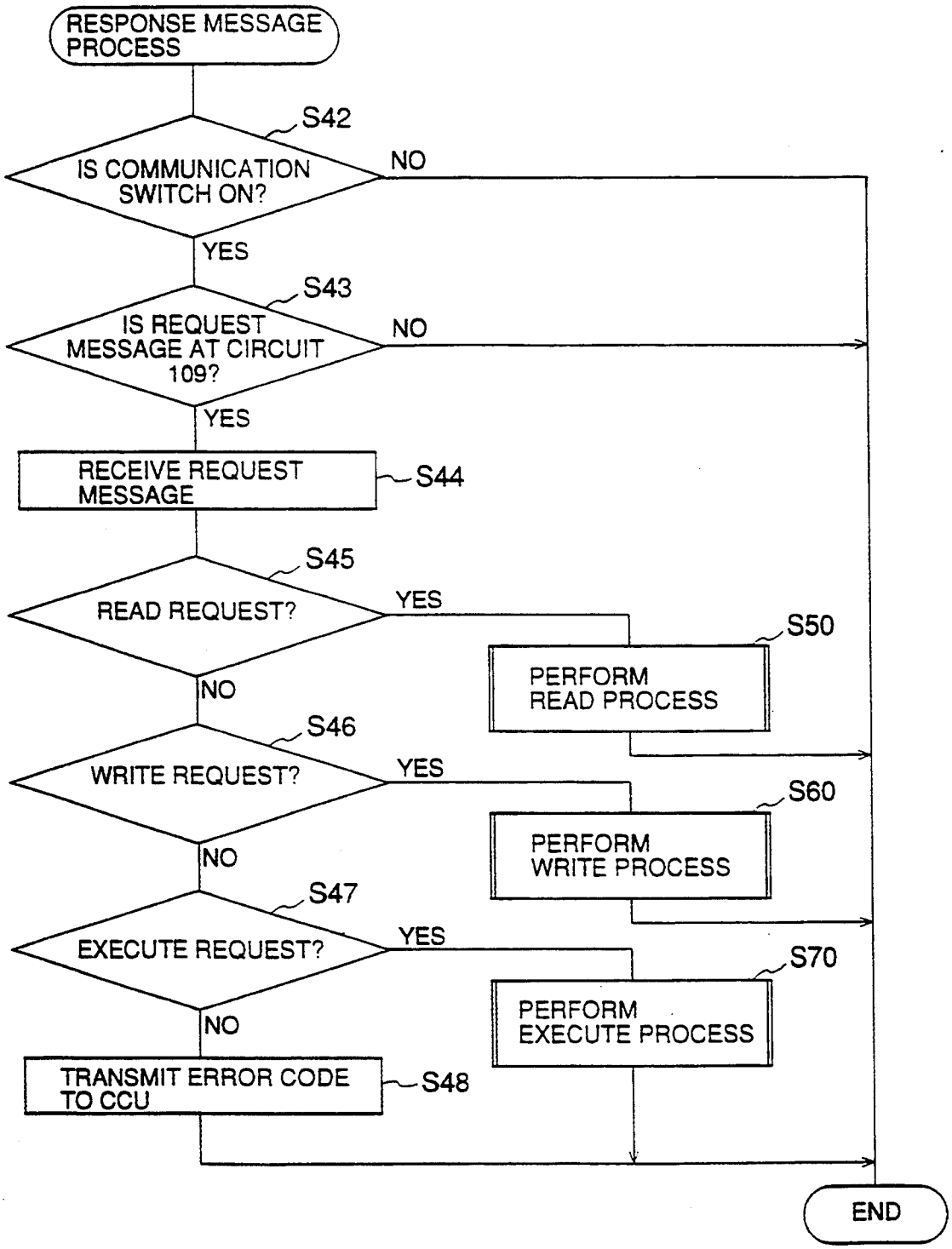
FIG. 27 is a flow diagram for explaining a main routine of the response message process performed by the control part of the image forming unit.

FIG. 27 shows a main routine of the response message process performed by the control part (the CPU 100) of the image forming unit 1 to perform the read, write and execute processes between the communication control unit 18 and the image forming unit 1. In the main routine in FIG. 27, the control part of the image forming unit 1, at step S42, detects whether or not the communication switch 111 is turned ON to allow the data transmission between the image forming unit 1 and the communication control unit 18.

If the result at step S42 is affirmative, step S43 detects whether or not the communication interface circuit 109 of the control part has a request message from the CCU 18. If the result at step S43 is affirmative, step S44 receives the request message from the CCU 18 and stores it in the RAM 102 of the control part of the image forming unit 1.

After step S44 is performed, step S45 detects whether or not the first entry of the received message is the read request code. If the result at step S44 is affirmative, step S50 performs the read process so that the image forming unit 1 transmits a response message to the CCU 18 in reply to the read request of the CCU 18. This read process will be described below.

If the result at step S45 is negative, step S46 is performed. Step S46 detects whether or not the first entry of the received message is the write request code. If the result at step S46 is affirmative, step S60 performs the write process so that the image forming unit 1 transmits a response message to the CCU 18 in reply to the write request of the CCU 18. This write process will be described below.

If the result at step S46 is negative, step S47 is performed. Step S47 detects whether or not the first entry of the received message is the execute request code. If the result at step S47 is affirmative, step S70 performs the execute process so that the image forming unit 1 transmits a response to the CCU 18 in reply to the execute request of the CCU 18. This execute process will be described.

If the result at step S47 is negative, step S48 transmits an error code back to the CCU 18. If any of the above steps S48, S50, S60 and S70 is finished, or if the result at step S42 or step S43 is negative, the main routine in FIG. 27 is finished.

Figure 28:
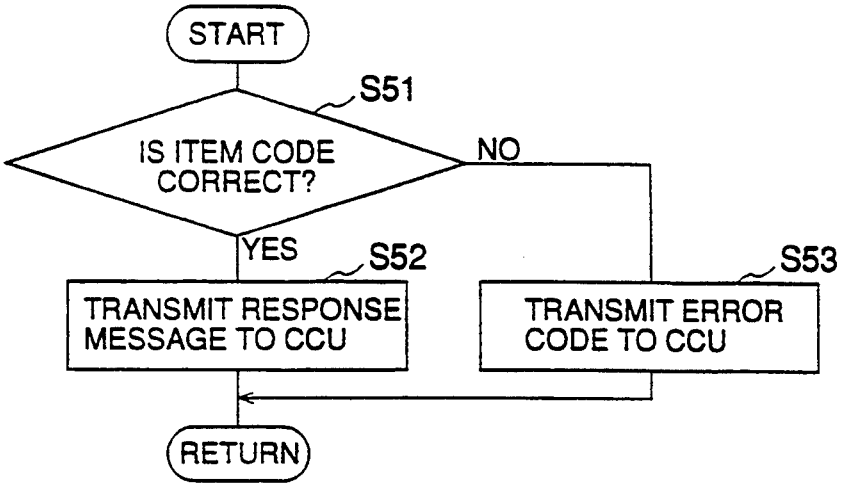
FIG. 28 is a flow diagram for explaining a sub-routine of the read process in the main routine in FIG. 27.

FIG. 28 shows a sub-routine of the read process in the main routine in FIG. 27. This sub-routine corresponds to the above step S50 of the main routine in FIG. 27. In FIG. 28, the control part of the image forming unit 1, at step S51, detects whether or not the item code of the read request message is a correct item code to indicate data that can be read. If the result at step S51 is affirmative, step S52 transmits a response message in reply to the read request message of the CCU 18 back to the CCU 18. If the result at step S51 is negative, step S53 transmits an error code back to the CCU 18.

Figure 29:
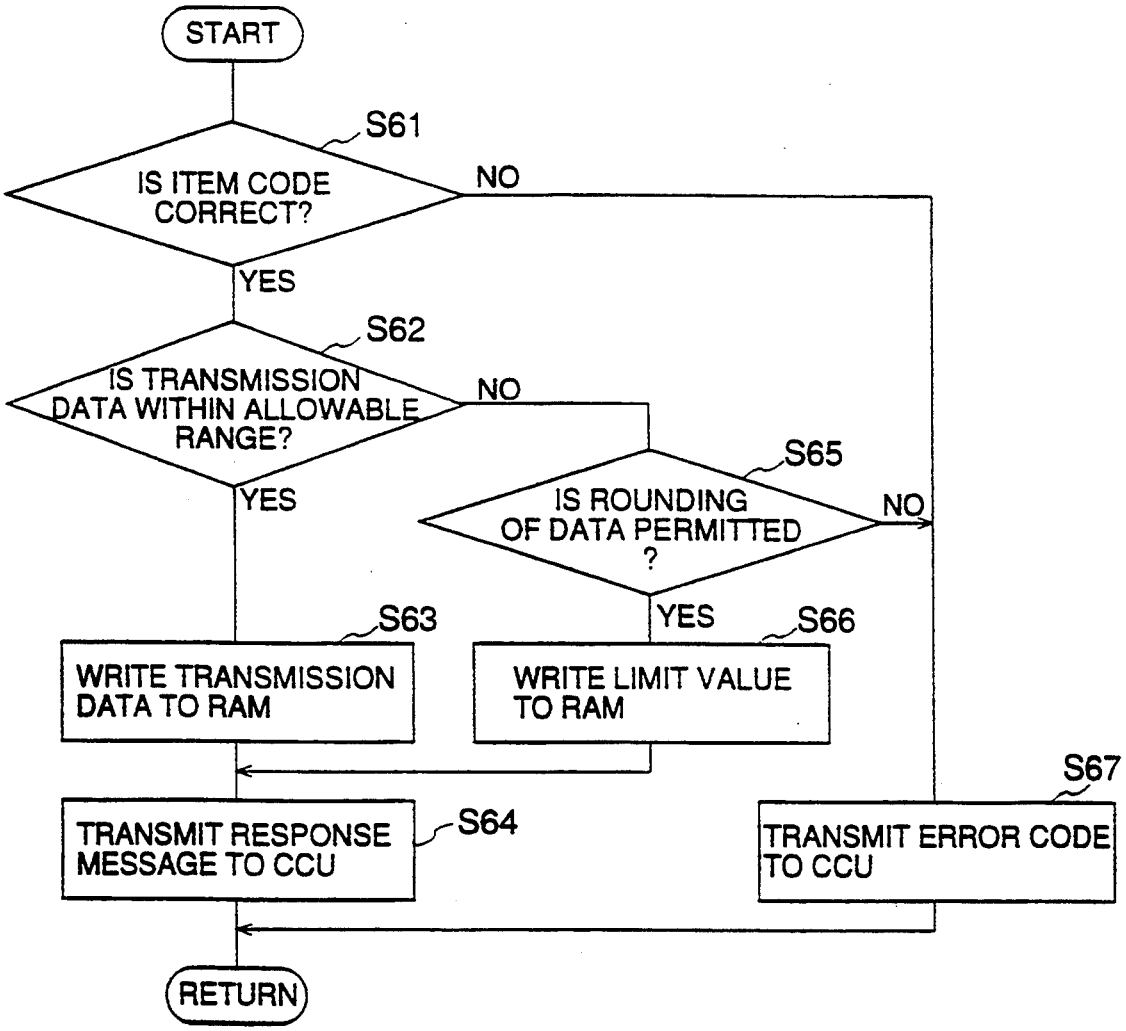
FIG. 29 is a flow diagram for explaining a sub-routine of the write process in the main routine in FIG. 27.

FIG. 29 shows a sub-routine of the write process in the main routine in FIG. 27. This sub-routine corresponds to the above step S60 of the main routine in FIG. 27. In FIG. 29, the control part of the image forming unit 1, at step S61, detects whether or not the item code of the write request message is a correct item code to indicate data that can be written to the RAM 102 of the control part. If the result at step S61 is affirmative, step S62 detects whether or not the transmission data of the request message falls within a given allowable range.

If the result at step S62 is affirmative, step S63 writes the transmission data of the write request message to the RAM 102 of the control part. After step S63 is performed, step S64 transmits a response message including the written data back to the CCU 18.

If the result at step S62 is negative, step S65 detects whether or not the rounding of the transmission data to a given limit value is permitted. If the result at step S65 is affirmative, step S66 writes the limit value to the RAM 102 of the control part. After step S66 is performed, the above step S64 is performed.

If the result at step S65 or step S61 is negative, step S67 is performed. Step S67 transmits an error code in reply to the write request, back to the CCU 18.

Figure 30:
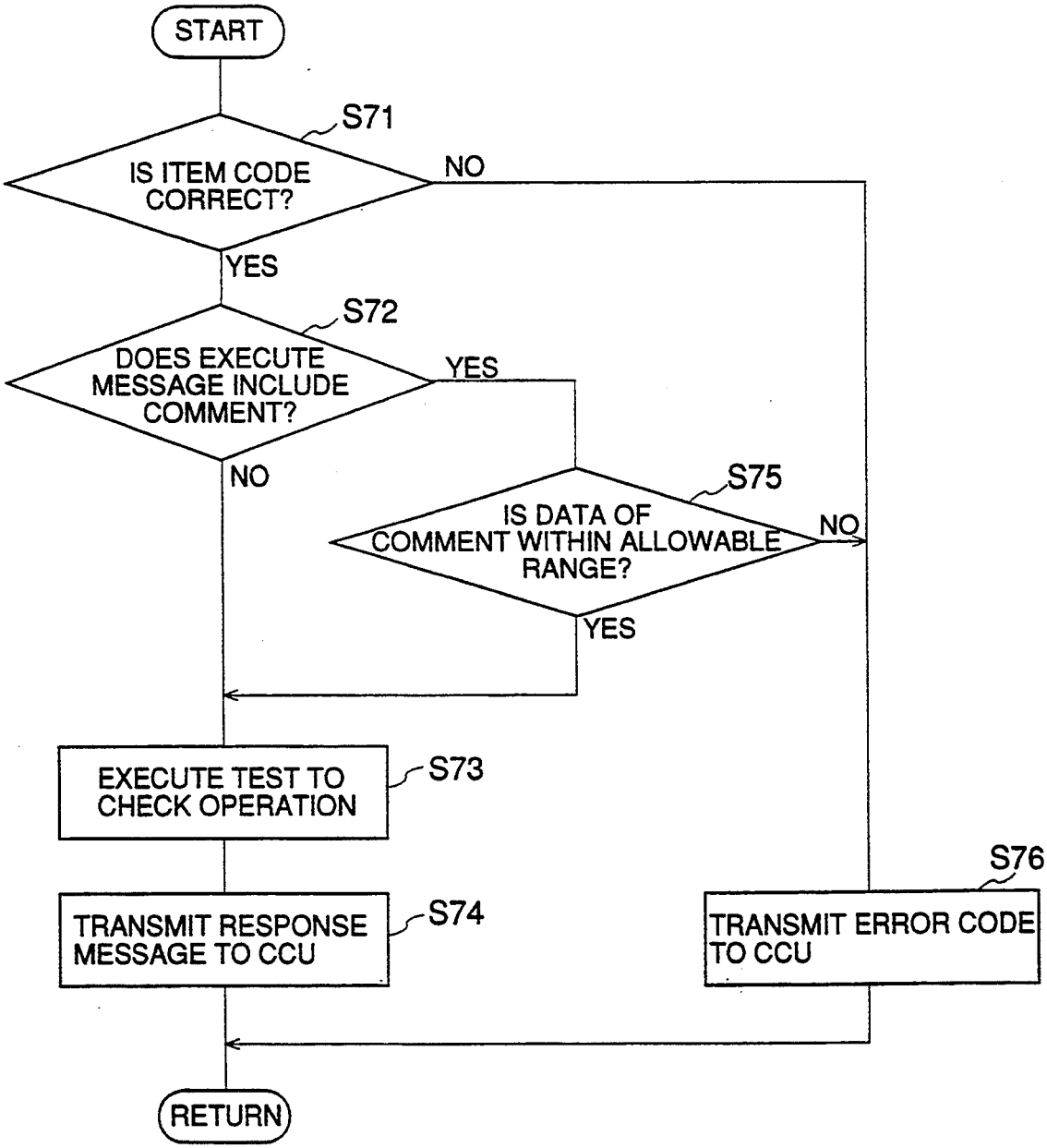
FIG. 30 is a flow diagram for explaining a sub-routine of the execute process in the main routine in FIG. 27.

FIG. 30 shows a sub-routine of the execute process in the main routine in FIG. 27. This sub-routine corresponds to the above step S70 of the main routine in FIG. 27. In FIG. 30, the control part of the image forming unit 1, at step S71, detects whether or not the item code of the execute request message is a correct item code to indicate the operation of the image forming unit 1 that can be checked by executing the test.

If the result at step S61 is affirmative, step S72 detects whether or not the comment describing the operation of the image forming unit 1 to be checked is included in the execute request message.

If the result at step S72 is affirmative, step S75 detects whether or not the comment of the execute request message falls within a given allowable range. If the result at step S72 is negative, or if the result at step S75 is affirmative, step S73 is performed. Step S73 executes the requested text to check the operation of the image forming unit 1. After step S73 is performed, step S74 transmits a response message indicating the result of the test to the CCU 18.

If the result at step S71 is negative, or if the result at step S75 is negative, step S76 is performed. Step S76 transmits an error code in reply to the execute request message, to the CCU 18.

Next, a description will be given, with reference to FIGS. 31 through 34, of the communication sequence between the plurality of image forming units and the communication unit.

Figure 31:
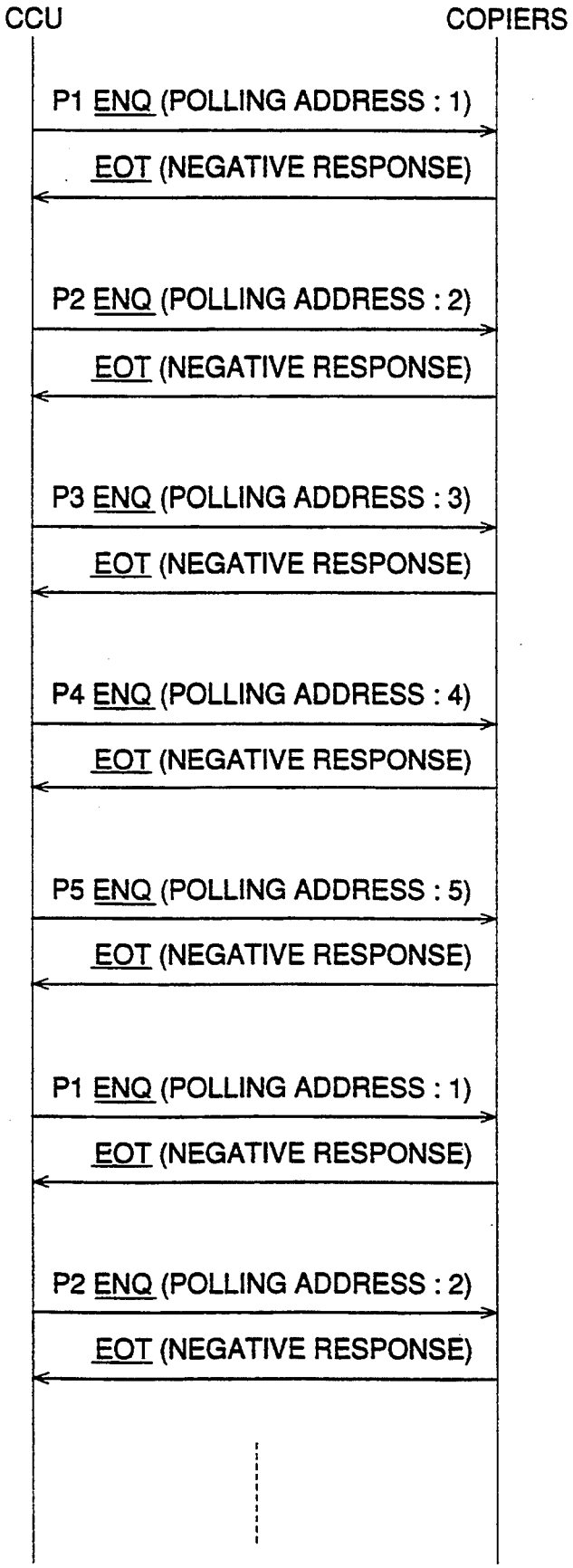
FIG. 31 is a chart showing the communication sequence between the communication control unit (CCU) and five image forming units connected to the CCU when no data is transmitted to the CCU.

FIG. 31 shows the communication sequence between the CCU and five image forming units (the PPC copiers) connected to the CCU when no data is transmitted from the image forming units to the CCU. In FIG. 31, the CCU performs a polling cycle procedure, so that the CCU sends the polling sequence to each of the image forming units by repeatedly setting the specific address of the address switch for the image forming unit of interest to establish the data link. The address of each of the five image forming units corresponds to the specific address of its address switch which ranges from 1 to 5. After each image forming unit receives from the CCU a polling sequence having the specific address of the image forming unit, the image forming unit sends a negative response back to the CCU since there is no data to be transmitted from the image forming unit to the CCU.

Figure 32:
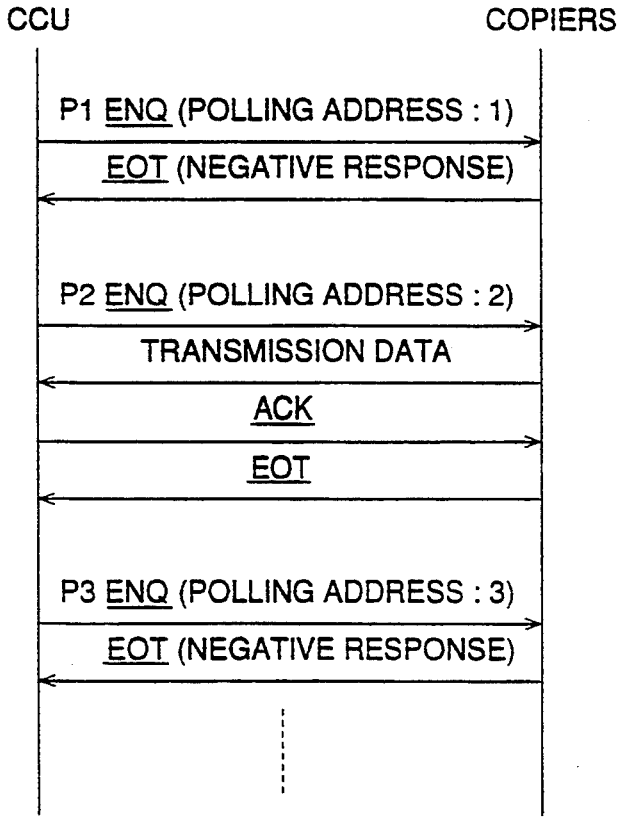
FIG. 32 is a chart showing the communication sequence between the CCU and the image forming units when remote message data is transmitted from the address-2 image forming unit to the CCU.

FIG. 32 shows the communication sequence between the CCU and the image forming units when remote message data is transmitted from the address-2 image forming unit to the CCU. In FIG. 32, after the address-2 image forming unit receives from the CCU the polling sequence, the image forming unit sends the remote message data to the CCU through the RS485 interface circuit. If the reception of the remote message data by the CCU is normally completed, the CCU transmits the acknowledgment signal to the image forming unit. After the image forming unit receives this signal from the CCU, the image forming unit transmits the end-of-transmission signal to the CCU.

Figure 33:
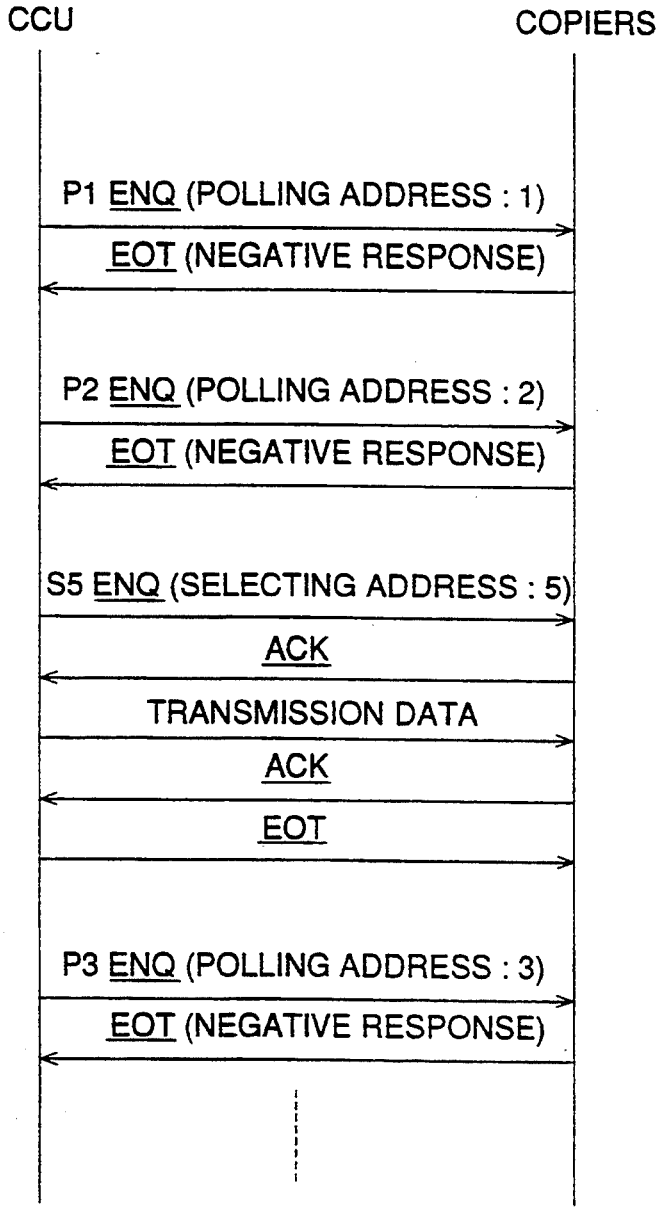
FIG. 33 is a chart showing the communication sequence between the CCU and the image forming units when response message data is transmitted from the CCU to the address-5 image forming unit.

FIG. 33 shows the communication sequence between the CCU and the image forming units when response message data is transmitted from the CCU to the address-5 image forming unit. In FIG. 33, after the CCU terminates the sending of the polling sequence to the five image forming units, the CCU sends the selecting sequence to the address-5 image forming unit of interest. After the CCU receives the acknowledgment signal from the image forming unit, the CCU transmits the response message data to the image forming unit through the RS485 interface circuit. If the reception of the remote message data by the image forming unit is normally completed, the image forming unit sends the acknowledgment signal to the CCU. After the CCU receives this signal from the image forming unit, the CCU sends the end-of-transmission signal to the image forming unit. Then, the CCU re-starts the sending of the polling sequence to the five image forming units.

Figure 34:
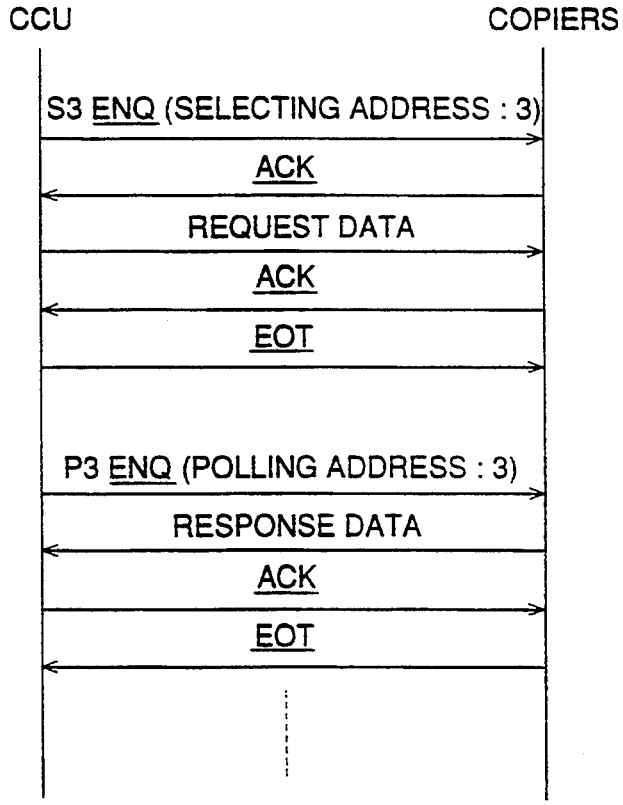
FIG. 34 is a chart showing the communication sequence between the CCU and the image forming units when read request data is transmitted from the CCU to the address-3 image forming unit.

FIG. 34 shows the communication sequence between the CCU and the image forming units when request data (which is one of the read, write and execute request data) is transmitted from the CCU to the address-3 image forming unit. In FIG. 34, the CCU sends the selecting sequence to the address-3 image forming unit of interest. After the CCU receives the acknowledgment signal from the image forming unit, the CCU transmits the request data to the image forming unit through the RS485 interface circuit. If the reception of the remote message data by the image forming unit is normally completed, the image forming unit sends the acknowledgment signal to the CCU. After the CCU receives this signal from the image forming unit, the CCU sends the end-of-transmission signal to the image forming unit.

After the sending of the end-of-transmission signal, the CCU sends the polling sequence to the address-3 image forming unit of interest. The image forming unit transmits the response data to the CCU. After the image forming unit receives the acknowledgment signal from the CCU, the image forming unit sends the end-of-transmission signal to the CCU.

Next, a description will be given, with reference to FIGS. 11 and 35 through 41, of the operation of the image forming unit management system according to the present invention. The image forming unit management system according to the present invention is operated in a manual call mode by making use of the remote message key of the operation part of the image forming unit as shown in FIG. 2 or FIG. 4. When the image forming unit management system is operated in the manual call mode, the user at the image forming unit may transmit a remote message to the management unit via the public network. In the following description, it is assumed that each image forming unit of the image forming unit management system is provided with the operation part 70 shown in FIG. 4, for the sake of convenience.

Figure 11:
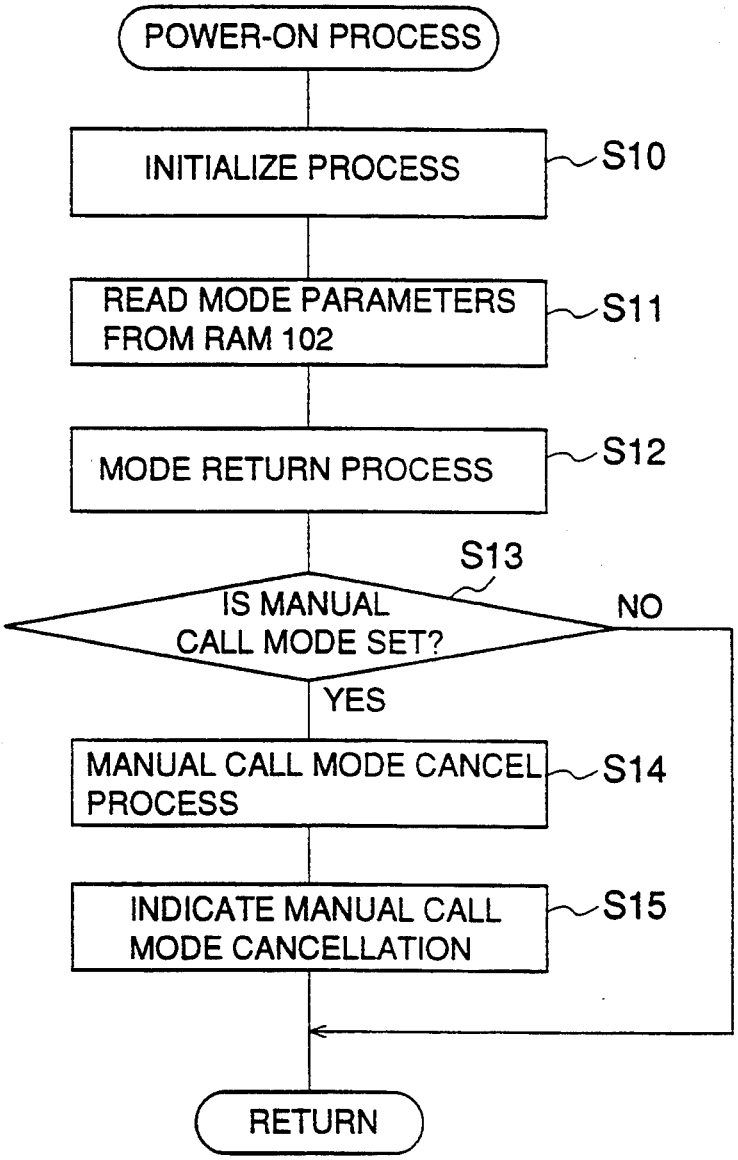
FIG. 11 is a flow diagram for explaining a power-on process performed by the control part of the image forming unit in FIG. 10.

FIG. 11 shows a power-on process performed by the control part of the image forming unit in FIG. 10. In FIG. 11, when the power switch of the image forming unit is turned on, the power-on process is performed by the control part (the CPU 100) of the image forming unit. In the power-on process in FIG. 11, the control part, at step S10, performs an initialization process for the image forming unit 1. Step S11 reads the parameters of all of the operative modes from the backup RAM 102. After step S11 is performed, step S112 performs a mode return process of the image forming unit.

In FIG. 11, step S13 detects whether or not the manual call mode of the image forming unit is being set. If the result at step S13 is negative, the power-on process in FIG. 11 is finished. If the result at step S13 is affirmative, step S14 performs a manual call mode cancel process. After step S14 is performed, step S15 indicates the cancellation of the manual call mode on the operation part of the image forming unit. The user at the image forming unit is informed by the operation part the manual call mode cancellation. The power-on process in FIG. 11 is finished.

Figure 35:
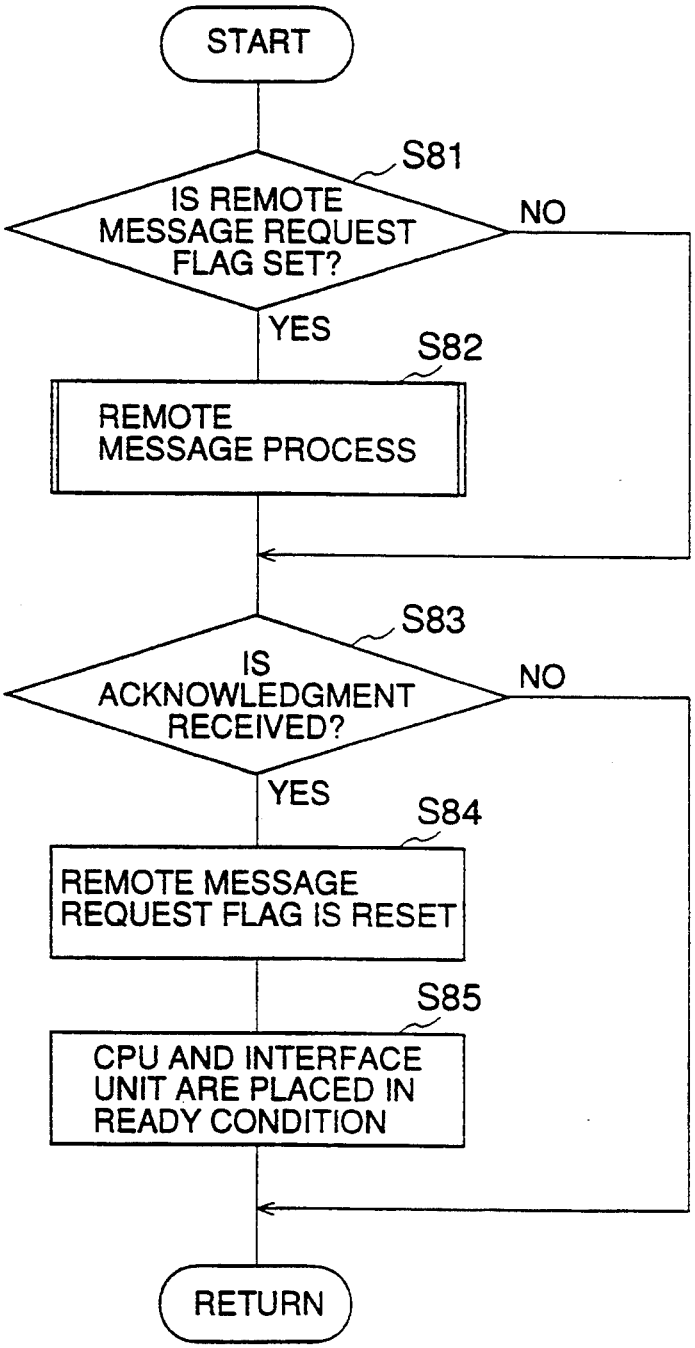
FIG. 35 is a flow diagram for explaining a battery action transmission process performed by the control part of the image forming unit.

FIG. 35 shows a remote message transmission process performed by the control part of the image forming unit. This remote message transmission process is started when it is requested. In FIG. 35, the control part (the CPU 100) of the image forming unit, at step S81, detects whether or not a remote message request flag is set. If the result at step S81 is affirmative, step S82 performs the above described remote message process with the CCU 18 so that the remote message is transmitted from the image forming unit 1 to the CCU 18.

After step S82 is performed, step S83 detects whether or not the acknowledgment signal is received from the CCU 18. If the result at step S83 is affirmative, step S84 resets the remote message request flag to zero. After step S84 is performed, step S85 places the CPU 100 and the communication interface unit 109 in a ready condition. On the other hand, if the result at step S83 is negative, the remote message transmission process in FIG. 35 is finished and the steps S84 and S85 are not performed.

If the result at step S81 is negative, the step S83 is performed and the step S82 is not performed.

Thus, even if the power of the image forming unit is turned off after the manual call mode is set, the remote message can be transmitted from the image forming unit to the CCU 18, so that the remote message is transmitted by the CCU 18 to the management unit 16 through the public network 17.

Figure 36:
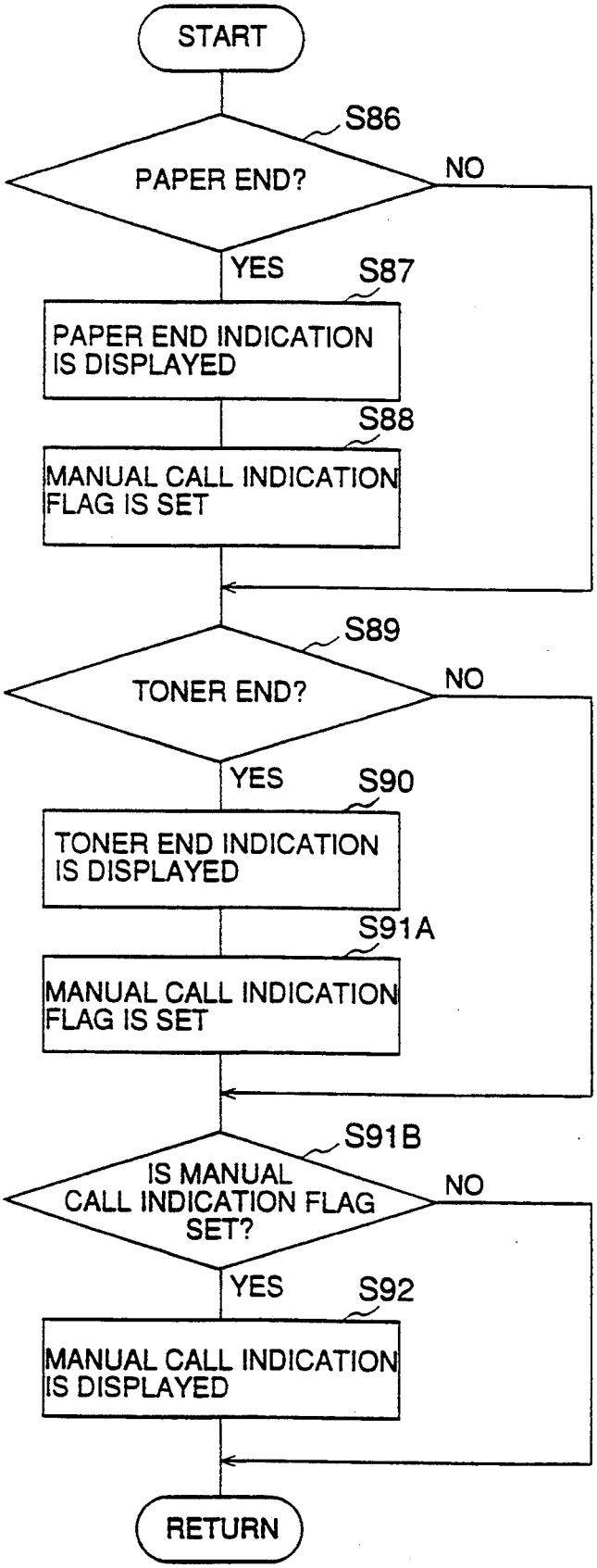
FIG. 36 is a flow diagram for explaining a manual call mode indication process performed by the control part of the image forming unit.

FIG. 36 shows a manual call mode indication process performed by the control part of the image forming unit. This manual call mode indication process is started when it is requested. In FIG. 36, the control part (the CPU 100) of the image forming unit 1, at step S86, detects whether or not the paper end has occurred in the image forming unit 1. If the result at step S86 is affirmative, step S87 displays the paper end indication on the operation part 70. After step S87 is performed, step S88 sets a manual call indication flag. If the result at step S86 is negative, the following step is performed and the steps S87 and S88 are not performed.

Step S89 detects whether or not the toner end has occurred in the image forming unit 1. If the result at step S89 is affirmative, steps S90 displays the toner end indication on the operation part 70. After step S90 is performed, step S91A sets the manual call indication flag. On the other hand, if the result at step S89 is negative, step S91B is performed, and the above steps S90 and S91A are not performed.

Figure 37:
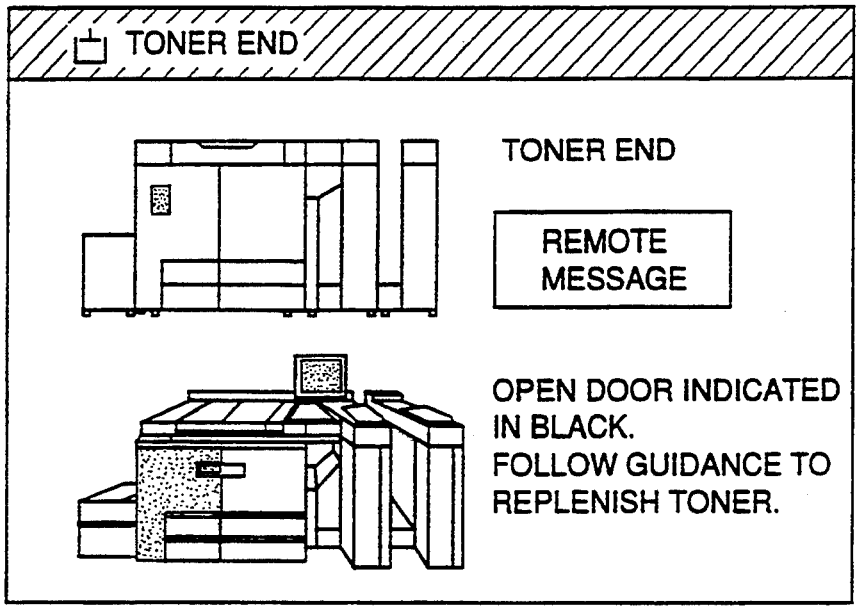
FIG. 37 is a diagram showing a toner end indication screen indicated on the operation part of the image forming unit.

Step S91B detects whether or not the manual call indication flag is set. If the result at step S91B is affirmative, step S92 displays the manual call indication on the display screen of the operation part 70 of the image forming unit. If the result at step S91B is negative, the manual call mode indication process in FIG. 36 is finished and the step S92 is not performed. With the manual call mode indication process described above, the error indication screen shown in FIG. 37 is indicated on the touch-panel display unit 121 if the toner end of the image forming unit is detected. If the remote message key in the error indication screen of FIG. 37 is depressed or touched by the user, the remote message process described above is performed to transmit the user message from the image forming unit to the CCU 18.

Figure 38:
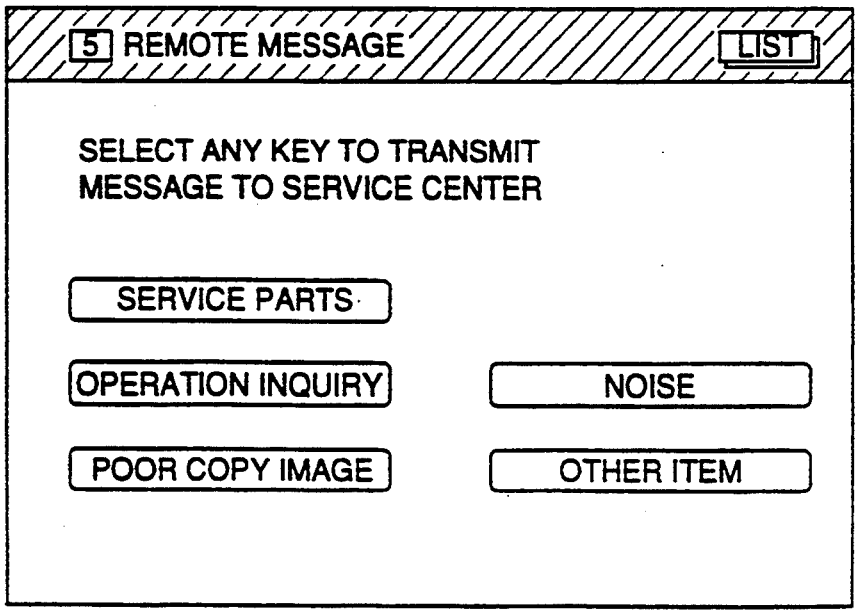
FIG. 38 is a diagram showing a manual call mode screen indicated on a modified operation part of the image forming unit.

FIG. 38 shows a manual call mode screen indicated on a modified operation part of the image forming unit. With the modified operation part of the image forming unit, the manual call mode screen of FIG. 38 is indicated on the touch-panel display unit 121. With this manual call mode screen in FIG. 38, a service parts key, an operation method inquiry key, a noise key, a poor copy image key and an other item key are indicated. If one of these keys is depressed or touched by the user, a user message relating to the selected item can be transmitted to the CCU 18 so that the user message is transmitted from the CCU 18 to the management unit 16 via the public network 17.

Figure 39:
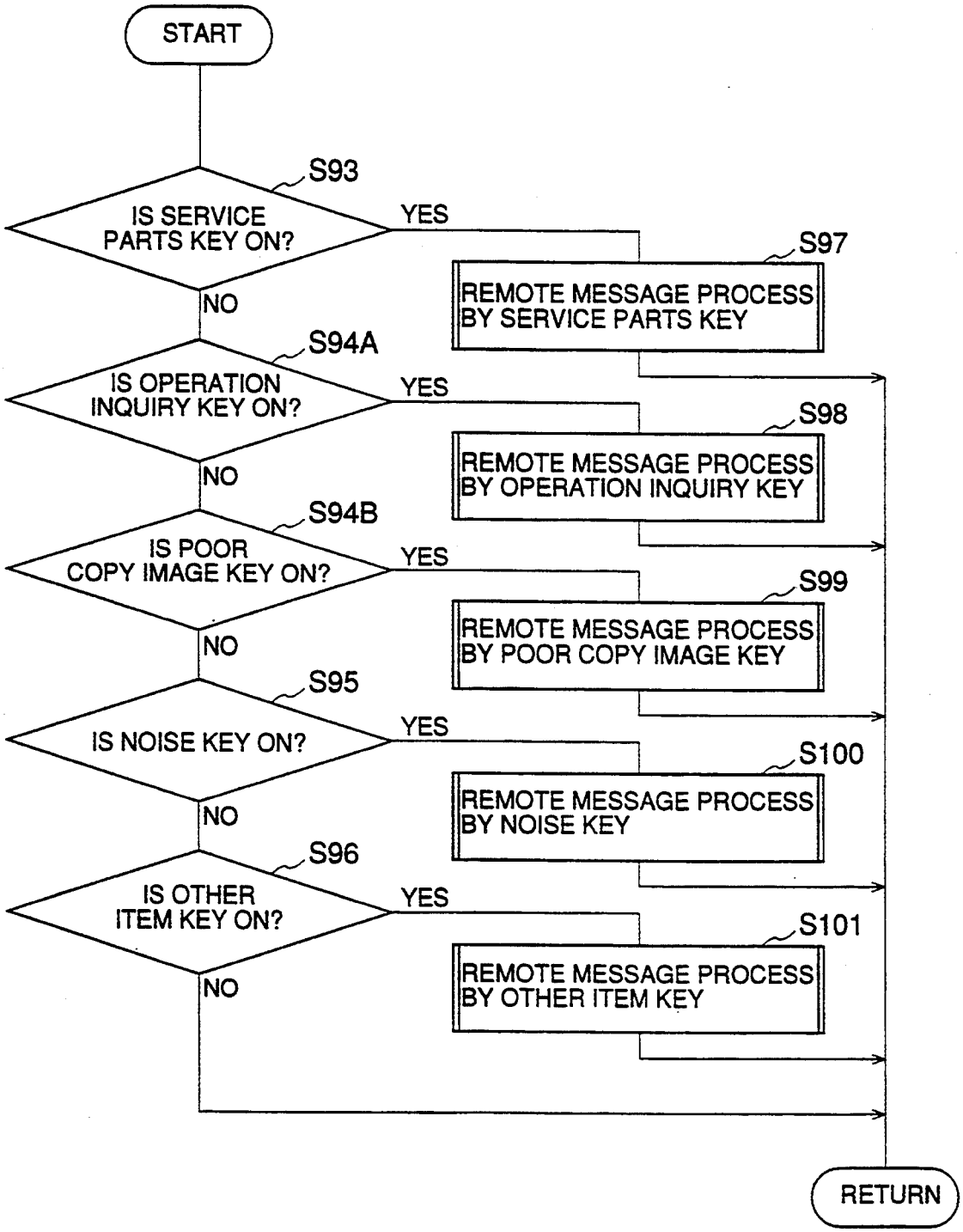
FIG. 39 is a flow diagram for explaining a remote message subroutine selection process performed by the control part of the image forming unit.

FIG. 39 shows a remote message subroutine selection process performed by the control part of the image forming unit. In the remote message subroutine selection process in FIG. 39, the control part (the CPU 100) of the image forming unit, at each of steps S93 through S96, detects which one of the keys displayed in the touch-panel display unit in FIG. 38 is depressed by the user. If the depression of one of these keys is depressed, the remote message process relating to the selected item (one of steps S97 through S101) is performed to transmit a corresponding user message from the image forming unit 1 to the CCU 18.

Figure 40:
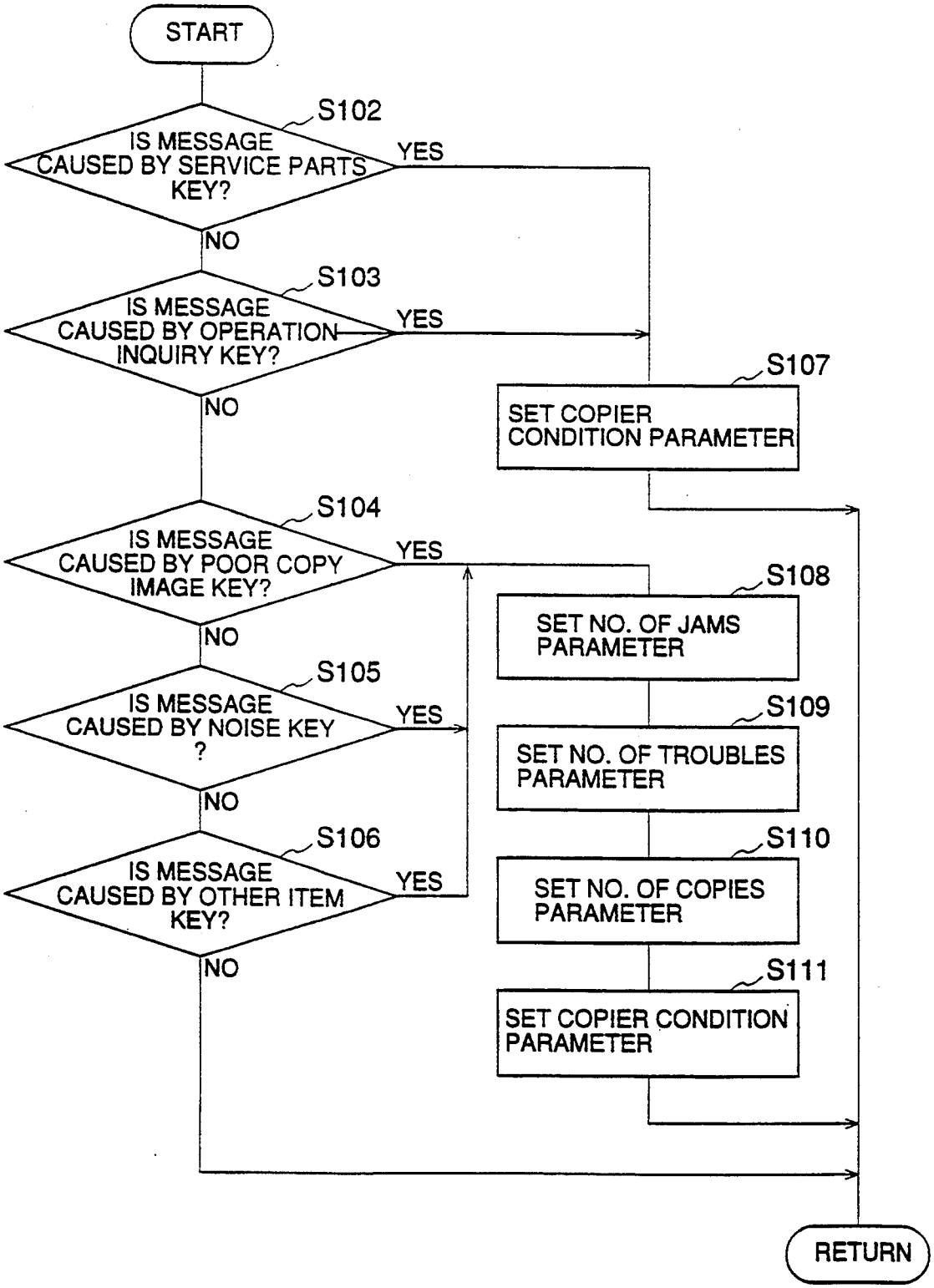
FIG. 40 is a flow diagram for explaining a data reduction process performed by the control part of the communication control unit.

FIG. 40 shows a data setting process performed by the control part of the communication control unit. The data reduction process in FIG. 40 is started when it is requested. In FIG. 40, the control part (the CPU 184) of the CCU 18, at step S102 or S103, detects whether the user message received from the image forming unit 1 is caused by the service parts key or by the operation inquiry key. If the result at one of steps S102 and S103 is affirmative, step S107 sets the copier condition parameter to the user message. At this time, the data setting process in FIG. 40 is finished. If the results at both steps S102 and S103 are negative, the following step is performed.

In FIG. 40, the CPU 184 of the CCU 18, at each of steps S104 through S106, detects whether the user message received from the image forming unit 1 is caused by the poor copy image key, by the noise key or by the other item key. If the result at one of steps S104–S106 is affirmative, steps S108, S109, S110 and S111 respectively set the number-of-jams parameter, the number-of-troubles parameter, the number-of-copies parameter and the copier condition parameter to the user message. At this time, the data setting process in FIG. 40 is finished. If the results at all of the steps S104–S106 are negative, the above steps S108–S111 are not performed and the data setting process in FIG. 40 is finished.

Figure 41:
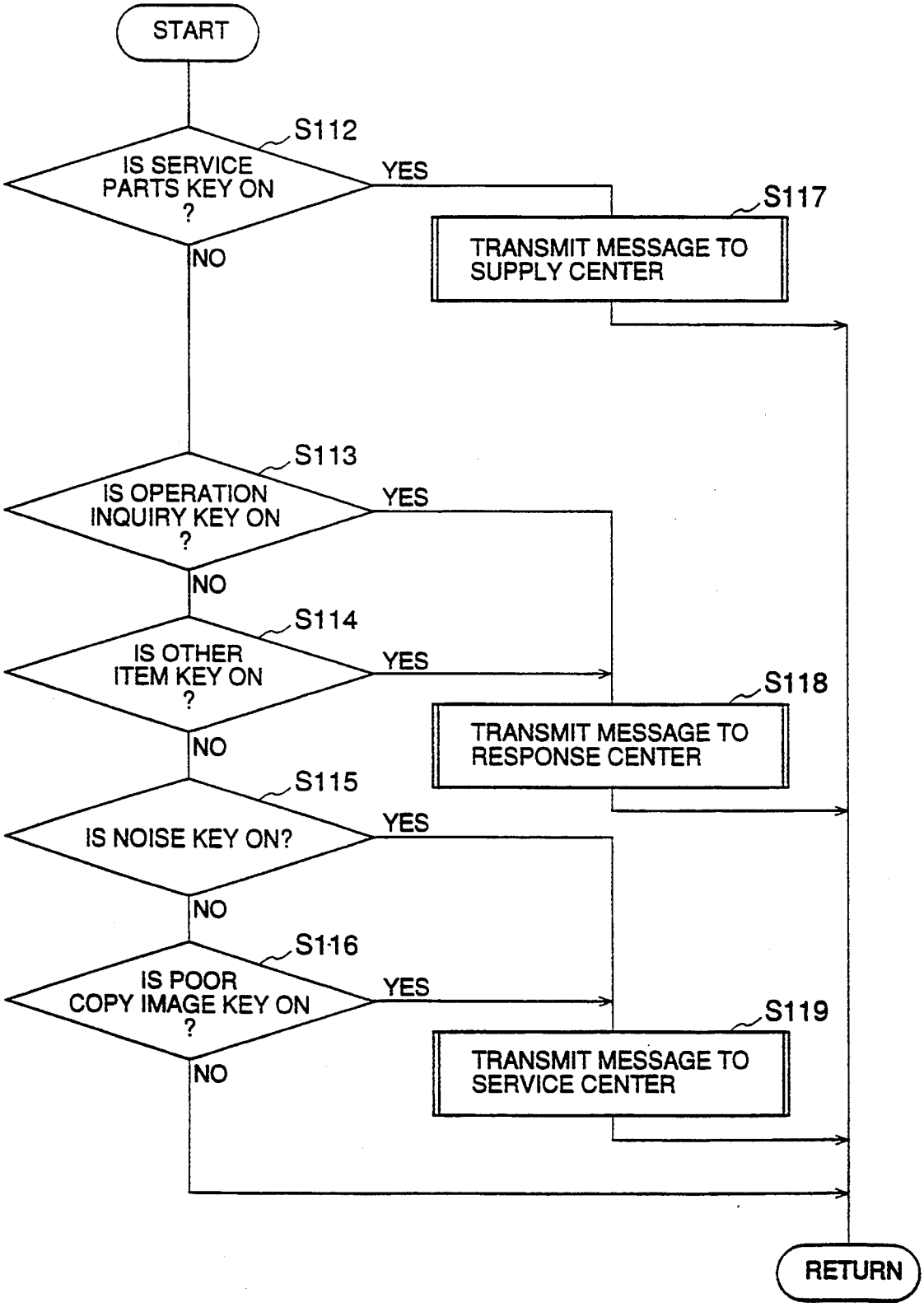
FIG. 41 is a flow diagram for explaining a data selection process performed by the control part of the communication control unit.

FIG. 41 shows a data selective transmission process performed by the control part of the communication control unit. The data selective transmission process in FIG. 41 is started when it is requested. In FIG. 41, the control part (the CPU 184) of the CCU 18, at step S112, detects whether or not the user message is caused by depressing the service parts key. If the result at step S112 is affirmative, step S117 transmits the user message to the management unit 16, which is located at, for example, a supply center, via the public network 17.

If the result at step S11 is negative, the CPU 184, at steps S13 and S114, detects whether the user message is caused by depressing the operation inquiry key or the other item key. If the result at one of steps S113 and S114 is affirmative, step S118 transmits the user message to the management unit 16, which is located at, for example, a response center, via the public network 17.

If the results at both steps S113 and S114 are negative, the CPU 184, at steps S115 and S116, detects whether the user message is caused by depressing the noise key or the poor copy image key. If the result at one of steps S115 and S11 is affirmative, step S119 transmits the user message to the management unit 16, which is located at, for example, a service center, via the public network 17.

Figure 42A:
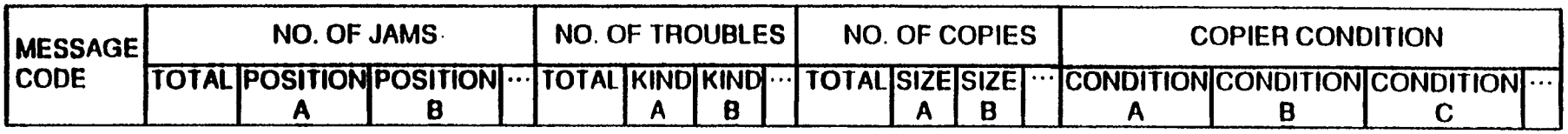
FIG. 42 is a diagram showing the data format of messages when another remote message process is performed.
Figure 42B:
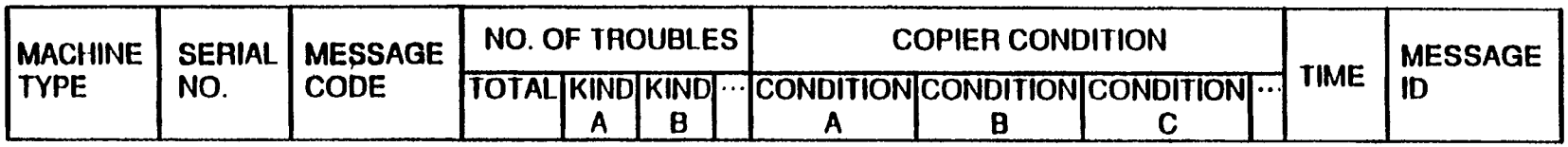
Figure 42C:
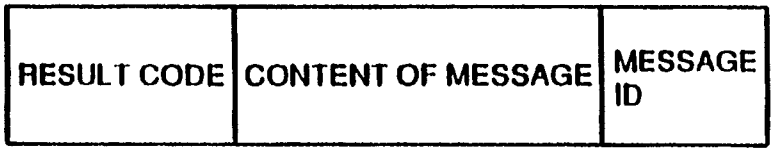

It is desirable that the CCU 18 adds a message identification number to a user message received from the image forming unit 1 so that the management unit 16 receives from the CCU 18 the user message with the message identification number. It is desirable that the CCU adds the message identification number to the response message to be sent to the image forming unit so that the message identification number of the response message is indicated on the operation part of the image forming unit at the time of the reception of the message. FIG. 42 shows the data format of messages when a remote message process of the type mentioned above is performed.

Further, the present invention is not limited to the above described embodiments, and variations and modifications may be made without departing from the scope of the present invention.

What is claimed is:

1. An image forming unit management system comprising:

an image forming unit;

a communication control unit for connecting the image forming unit to a management unit via a communication line to transmit a user message from the image forming unit to the management unit and to transmit a response message from the management unit to the image forming unit;

storage means for storing a plurality of message codes respectively indicating a plurality of message types;

operation means provided in the image forming unit for inputting a message type and a request that a user message of the message type is transmitted from the image forming unit to the management unit through the communication control unit;

first control means coupled to said operation means for setting one of the plurality of message codes stored in said storage means, that corresponds to the message type inputted from the operation means, and for transmitting a user message including said message code to the communication control unit if the request is inputted from the operation means; and second control means provided in the communication control unit for transmitting the user message, received from said first control means, to the management unit, and for transmitting a response message to the image forming unit when the response message is received from the management unit.

2. An image forming unit management system according to claim 1, wherein said image forming unit comprises means for canceling a manual call mode in which the inputting of a request from the operation means is allowed, if a power supply of the image forming unit is turned off and on before the request is inputted from said operation means.

3. An image forming unit management system according to claim 1, wherein said communication control unit comprises means for allowing said second control means to transmit the user message, received from said first control means, to the management unit if a power supply of the image forming unit is turned off after a request is inputted from said operation means.

4. An image forming unit management system according to claim 1, wherein said image forming unit comprises means for supplying electric power to said storage means if a power supply of the image forming unit is off, so that said communication control unit can receives from the first control means a user message including the message code and the data items stored in said storage means after the power supply of the image forming unit is off.

5. An image forming unit management system according to claim 1, wherein said operation means comprises means for displaying a remote message key on a display part of the image forming unit when a manual call indication flag is set, and a request is inputted from said operation means when said key is depressed by a user.

6. An image forming unit management system according to claim 1, wherein said operation means comprises means for displaying a plurality of keys corresponding to a plurality of user message types on a display part of the image forming unit when a manual call indication flag is set, and a request is inputted from said operation means when one of said plurality of keys is depressed by a user.

7. An image forming unit management system according to claim 1, wherein said operation means comprises means for setting a user message type when one of a plurality of keys corresponding to a plurality of user message types is depressed by a user, and for adding the message code of said user message type to a user message which is transmitted by said first control means to the communication control unit.

8. An image forming unit management system according to claim 1, wherein said communication control unit comprises means for adding a message identification number to a user message which is transmitted by said second control means to the management unit.

9. An image forming unit management system according to claim 1, wherein said communication control unit comprises means for detecting the user message type of the user message received from said first control means to determine a message code of the user message based on the user message type, and for adding said message code to a user message which is transmitted by said second control means to the management unit.

10. An image forming unit management system according to claim 1, wherein said storage means stores, with respect to each of the plurality of message types, a set of data items indicating the number of jams, the number of troubles, the number of copies and a working condition of the image forming unit.

11. An image forming unit management system according to claim 10, wherein said first control means transmits a user message including said message code and at least one of said data items, stored in the storage means and corresponding to the input message type, to the communication control unit if the request is inputted from the operation means.

12. An image forming unit management system comprising:

an image forming unit;

a plurality of management units located at remote sites;

a communication control unit for connecting the image forming unit to each of the plurality of management units via a communication line to transmit a user message from the image forming unit to the management unit of interest;

storage means provided in the image forming unit for storing a plurality of message codes respectively indicating a plurality of message types;

operation means provided in the image forming unit for inputting a message type and a request that a user message of the message type is transmitted from the image forming unit to the management unit through the communication control unit;

first control means coupled to said operation means for setting one of the plurality of message codes stored in the storage means, that corresponds to the message type inputted from the operation means, and for transmitting a user message including said message code to the communication control unit if the request is inputted from the operation means;

second control means provided in the communication control unit for detecting the message code of the user message received from said first control means to determine a destination management unit among the plurality of management units; and third control means coupled to said second control means for transmitting the user message, received from said first control means, to said destination management unit via the communication line.

13. An image forming unit management system according to claim 12, wherein said storage means stores, with respect to each of the plurality of message types, a set of data items indicating the number of jams, the number of troubles, the number of copies and a working condition of the image forming unit.

14. An image forming unit management system according to claim 13, wherein said first control means transmits a user message including said message code and at least one of said data items stored in the storage means and corresponding to the input message type, to the communication control unit if the request is inputted from the operation means.

* * * * *